US007427752B2

(12) United States Patent
Jones et al.

(10) Patent No.: US 7,427,752 B2
(45) Date of Patent: Sep. 23, 2008

(54) MASS SPECTROMETER

(75) Inventors: Gareth Rhys Jones, Cheshire (GB); Robert Harold Bateman, Cheshire (GB)

(73) Assignee: Micromass UK Limited, Manchester (GB)

( * ) Notice: Subject to any disclaimer, the term of this patent is extended or adjusted under 35 U.S.C. 154(b) by 324 days.

(21) Appl. No.: 10/535,053

(22) PCT Filed: Oct. 28, 2003

(86) PCT No.: PCT/GB03/04658

§ 371 (c)(1),
(2), (4) Date: Jul. 12, 2006

(87) PCT Pub. No.: WO2004/047143

PCT Pub. Date: Jun. 3, 2004

(65) Prior Publication Data

US 2007/0034796 A1 Feb. 15, 2007

Related U.S. Application Data

(60) Provisional application No. 60/427,558, filed on Nov. 20, 2002.

(30) Foreign Application Priority Data

Nov. 15, 2002 (GB) ..... 0226715.1

(51) Int. Cl.
*H01J 49/30* (2006.01)
*H01J 49/32* (2006.01)

(52) U.S. Cl. ..... 250/299; 250/282

(58) Field of Classification Search ..... 250/298, 250/299, 300, 281, 282
See application file for complete search history.

(56) References Cited

U.S. PATENT DOCUMENTS

| | | | | |
|---|---|---|---|---|
| 3,770,337 | A * | 11/1973 | Merren | 250/282 |
| 4,524,275 | A | 6/1985 | Cottrell et al. | |
| 4,672,204 | A | 6/1987 | Slodzian et al. | |
| 4,896,035 | A | 1/1990 | Mahoney et al. | |
| 5,202,561 | A | 4/1993 | Glessmann et al. | |
| 5,220,167 | A * | 6/1993 | Brown et al. | 250/281 |
| 5,471,059 | A * | 11/1995 | Freedman et al. | 250/299 |

FOREIGN PATENT DOCUMENTS

| | | |
|---|---|---|
| DE | 199 53 300 | 5/2000 |
| DE | 196 35 645 | 12/2000 |
| EP | 0 551 999 | 7/1993 |
| EP | 0 611 169 A1 | 2/1994 |
| EP | 1 339 089 | 4/1999 |
| FR | 2 829 287 | 9/2001 |

OTHER PUBLICATIONS

Saxton, J. M. et al: "The Manchester Isolab 54 ion microprobe" Elsevier Scientific Publishing Co., vol. 154, No. 1, (May 31, 1996), pp. 99-131.

* cited by examiner

*Primary Examiner*—Jack I Berman
(74) *Attorney, Agent, or Firm*—Jamie H. Rose; Anthony J. Janiuk

(57) ABSTRACT

A magnetic sector mass spectrometer is disclosed comprising an ion detector (11) wherein a reflecting electrode (13) is used to divide an ion beam in the direction of mass dispersion into two separate ion beams. The two ion beams are directed onto two detectors which preferably comprise two or more conversion dynodes (15*a*, 15*b*) and two or more corresponding microchannel plate detectors (14*a*, 14*b*) to detect electrons produced by the conversion dynodes (15*a*, 15*b*). If the signal from the two detectors differs substantially then the ion beam can be determined to include interference ions. Conversely, if the signal from the two detectors is substantially the same then the ion beam can be determined to be substantially free from interference ions.

72 Claims, 11 Drawing Sheets

| Column 1 | Column 2 | Column 3 | Column 4 | Column 5 | Column 6 | Column 7 | Column 8 | Column 9 | Column 10 | Column 11 |
|---|---|---|---|---|---|---|---|---|---|---|
| Ion Beam Shift (ppm) | Count on 1st detector | Count on 2nd detector | Total count | Average count per detector | Std dev (σa) for average | Difference D1 in units of (σa) | Difference D2 in units of (σa) | P1 (%) | P2 (%) | P (%) |
| i = | s1(i) = | s2(i) = | s(i) = | sa(i) = | σa(i) = | D1(i) = | D2(i) = | P1(i) = | P2(i) = | Pr(i) = |
| -25 | 0 | 10 | 10 | 5 | 2.24 | 2.24 | 2.24 | 97.47 | 97.47 | 0.064 |
| -20 | 0.5 | 12.6 | 13.1 | 6.55 | 2.56 | 2.37 | 2.37 | 98.21 | 98.21 | 0.032 |
| -15 | 1.9 | 14 | 15.9 | 7.94 | 2.82 | 2.14 | 2.14 | 96.76 | 96.76 | 0.105 |
| -10 | 4.1 | 14 | 18.1 | 9.05 | 3.01 | 1.64 | 1.64 | 89.83 | 89.83 | 1.033 |
| -5 | 6.9 | 12.6 | 19.5 | 9.76 | 3.12 | 0.91 | 0.91 | 63.77 | 63.77 | 13.125 |
| 0 | 10 | 10 | 20 | 10 | 3.16 | 0 | 0 | 0 | 0 | 100 |
| 5 | 12.6 | 6.9 | 19.5 | 9.76 | 3.12 | 0.91 | 0.91 | 63.77 | 63.77 | 13.125 |
| 10 | 14 | 4.1 | 18.1 | 9.05 | 3.01 | 1.64 | 1.64 | 89.83 | 89.83 | 1.033 |
| 15 | 14 | 1.9 | 15.9 | 7.94 | 2.82 | 2.14 | 2.14 | 96.76 | 96.76 | 0.105 |
| 20 | 12.6 | 0.5 | 13.1 | 6.55 | 2.56 | 2.37 | 2.37 | 98.21 | 98.21 | 0.032 |
| 25 | 10 | 0 | 10 | 5 | 2.24 | 2.24 | 2.24 | 97.47 | 97.47 | 0.064 |

FIG. 11

| Column 1 | Column 2 | Column 3 | Column 4 | Column 5 | Column 6 | Column 7 | Column 8 | Column 9 | Column 10 | Column 11 |
|---|---|---|---|---|---|---|---|---|---|---|
| Ion Beam Shift (ppm) | Count on 1st detector | Count on 2nd detector | Total count | Average count per detector | Std dev (σa) for average | Difference D1 in units of (σa) | Difference D2 in units of (σa) | P1 (%) | P2 (%) | P (%) |
| i = | s1(i) = | s2(i) = | s(i) = | sa(i) = | σa(i) = | D1(i) = | D2(i) = | P1(i) = | P2(i) = | Pr(i) = |
| -45 | 23.2 | 69 | 92.2 | 46.11 | 6.79 | 3.37 | 3.37 | 99.93 | 99.93 | 0 |
| -40 | 25.9 | 67.9 | 93.8 | 46.91 | 6.85 | 3.07 | 3.07 | 99.78 | 99.78 | 0 |
| -35 | 28.7 | 66.5 | 95.2 | 47.62 | 6.9 | 2.74 | 2.74 | 99.39 | 99.39 | 0 |
| -30 | 31.6 | 64.9 | 96.5 | 48.24 | 6.95 | 2.4 | 2.4 | 98.35 | 98.35 | 0.027 |
| -25 | 34.5 | 63 | 97.6 | 48.78 | 6.98 | 2.04 | 2.04 | 95.84 | 95.84 | 0.173 |
| -20 | 37.6 | 60.9 | 98.4 | 49.21 | 7.02 | 1.66 | 1.66 | 90.32 | 90.32 | 0.937 |
| -15 | 40.6 | 58.5 | 99.1 | 49.56 | 7.04 | 1.27 | 1.27 | 79.52 | 79.52 | 4.194 |
| -10 | 43.7 | 55.9 | 99.6 | 49.8 | 7.06 | 0.86 | 0.86 | 61.02 | 61.02 | 15.191 |
| -5 | 46.9 | 53 | 99.9 | 49.95 | 7.07 | 0.44 | 0.44 | 33.81 | 33.81 | 43.817 |
| 0 | 50 | 50 | 100 | 50 | 7.07 | 0 | 0 | 0 | 0 | 100 |
| 5 | 53 | 46.9 | 99.9 | 49.95 | 7.07 | 0.44 | 0.44 | 33.81 | 33.81 | 43.817 |
| 10 | 55.9 | 43.7 | 99.6 | 49.8 | 7.06 | 0.86 | 0.86 | 61.02 | 61.02 | 15.191 |
| 15 | 58.5 | 40.6 | 99.1 | 49.56 | 7.04 | 1.27 | 1.27 | 79.52 | 79.52 | 4.194 |
| 20 | 60.9 | 37.6 | 98.4 | 49.21 | 7.02 | 1.66 | 1.66 | 90.32 | 90.32 | 0.937 |
| 25 | 63 | 34.5 | 97.6 | 48.78 | 6.98 | 2.04 | 2.04 | 95.84 | 95.84 | 0.173 |
| 30 | 64.9 | 31.6 | 96.5 | 48.24 | 6.95 | 2.4 | 2.4 | 98.35 | 98.35 | 0.027 |
| 35 | 66.5 | 28.7 | 95.2 | 47.62 | 6.9 | 2.74 | 2.74 | 99.39 | 99.39 | 0 |
| 40 | 67.9 | 25.9 | 93.8 | 46.91 | 6.85 | 3.07 | 3.07 | 99.78 | 99.78 | 0 |
| 45 | 69 | 23.2 | 92.2 | 46.11 | 6.79 | 3.37 | 3.37 | 99.93 | 99.93 | 0 |

FIG. 12

MASS SPECTROMETER

The present invention relates to a magnetic sector mass spectrometer and a method of a mass spectrometry.

Magnetic sector mass spectrometers are commonly used for target compound trace analysis, accurate mass measurements, isotope ratio measurements and fundamental ion chemistry studies. Magnetic sector mass spectrometers are arranged to transmit ions having a particular mass to charge ratio to an ion detector. As described in more detail below, ions pass through the magnetic sector mass analyser on a substantially circular trajectory. A magnetic sector mass analyser may more accurately be described as being an ion momentum analyser but if the initial energies of the ions are substantially the same then the ions will become separated according to their mass to charge ratio.

Ions having a mass m and a charge ze when accelerated through an electrical potential difference V will attain a velocity v and possess a kinetic energy $\epsilon$ wherein:

$$\varepsilon = zeV = \frac{mv^2}{2}$$

and hence:

$$v^2 = \frac{2zeV}{m}$$

Ions with a charge ze moving through a magnetic field B with a velocity v will be subject to a Lorentz force F in a direction orthogonal to both the direction of the magnetic field and the direction of travel of the ions. The Lorentz force F will exert a centripetal force on the ions causing them to travel in a circular trajectory having a radius $r_m$. The Lorentz force F is:

$$F = Bzev = \frac{mv^2}{r_m}$$

Accordingly, the mass to charge ratio of the ions travelling through the magnetic field is given by:

$$\frac{m}{ze} = \frac{Bvr_m}{v^2}$$

and hence:

$$\left(\frac{mv}{ze}\right) = Br_m$$

Therefore, eliminating $v^2$ from the above equation for mass to charge ratio gives:

$$\frac{m}{ze} = Bvr_m\left(\frac{m}{2zeV}\right) = \frac{Br_m}{2V}\left(\frac{mv}{ze}\right)$$

-continued $$\frac{m}{ze} = \frac{B^2r_m^2}{2V}$$

From this it can be seen that the values of the magnetic field B and the potential difference V may be set so that ions having a particular mass to charge ratio received from an ion source are transmitted by the magnetic sector to the ion detector. In this manner the magnetic sector acts as a mass to charge ratio filter. Accordingly, a mass spectrum can be recorded by scanning either the magnetic field B and/or the potential difference V.

For some applications multiple ion detectors may be provided so that ions having different mass to charge ratios may be simultaneously recorded wherein each ion takes a different trajectory through the magnetic sector. Alternatively, an array of detectors may be used to simultaneously record a portion of the mass spectrum.

According to another arrangement, the magnetic field may be maintained substantially constant so that ions are dispersed according to their momentum. The momentum $\rho$ of an ion having a mass m, velocity v and kinetic energy $\epsilon$ is given by:

$$\rho = mv = \sqrt{2m\epsilon}$$

Therefore, ions with a constant kinetic energy $\epsilon$ are, in effect, dispersed according to their mass.

The shape of a magnetic sector can be designed to have ion directional focusing properties. A magnetic sector mass analyser may be designed to have a particular combination of mass dispersion and directional focusing characteristics in the direction of mass dispersion.

A conventional single focusing magnetic sector mass spectrometer comprises an ion source, a magnetic sector mass analyser and a collector slit. The ion source has a finite emitting region or slit width which defines the width of the ion beam emitted from the ion source. The magnetic sector mass analyser may have convergent directional focusing characteristics in order to focus the ions to an image point in a focal plane downstream of the magnetic sector mass analyser. In a single focusing magnetic sector mass spectrometer an ion collector slit is positioned at the image point of the ion source slit. The directional focusing characteristics of the magnetic sector mass analyser can be designed to a very high order. However, the imaging properties of the magnetic sector mass analyser will be limited by any spread in the initial energy of the ions.

The mass dispersion coefficient $D_m$ of a single focusing magnetic sector mass spectrometer is proportional to the radius of curvature $r_m$ of the ion beam trajectory in the magnetic field. The spatial separation y of two ions having different masses of mean mass m and mass difference $\Delta m$ is related to the mass dispersion coefficient $D_m$ and is:

$$y = \frac{D_m \Delta m}{m}$$

The ion beam width $w_b$ at the image position downstream of the magnetic sector mass analyser is related to the ion source slit width $w_s$, the image lateral magnification M and the sum of the imaging aberration coefficients $\Sigma\alpha$ as follows:

$$w_b = Mw_s + \Sigma\alpha$$

The mass resolving power m/Δm for a collector slit having a collector slit width $w_c$ is given by:

$$\frac{m}{\Delta m} = \frac{D_m}{w_b + w_c} = \frac{D_m}{Mw_s + w_c + \sum \alpha}$$

Thus, the mass dispersion coefficient $D_m$, the ion source slit width $w_s$ and the collector slit width $w_c$ are the most significant parameters in determining the mass resolution of a magnetic sector mass spectrometer. However, the ultimate mass resolution will be limited by the sum of the imaging aberrations.

As discussed above, magnetic sectors employing a constant magnetic field disperse ions with respect to the momentum of the ions and hence with respect to the mass of the ions if the ions are mono-energetic. However, ions will not normally be mono-energetic and will often have a range of kinetic energies depending upon the particular type of ion source used to generate the ions. The spread in ion energies acts to broaden the ion beam width $w_b$ at the image position and this typically becomes the limiting factor in achieving high resolution.

Momentum dispersion may be considered as comprising a combination of mass dispersion and energy dispersion. Electric sectors are known which will disperse ions according to their energy. Accordingly, if an electric sector is combined with a magnetic sector then the overall energy dispersion of the ions can be modified. Double focusing magnetic sector mass analysers are known comprising a combination of a magnetic sector mass analyser and one or more electric sectors wherein directional focusing is provided and wherein the overall energy dispersion is zero. If the double focussing magnetic sector mass analyser comprises an electric sector having an energy dispersion $D_{el}$, a magnetic sector having an energy dispersion $D_{e2}$ and wherein the image magnification is $M_2$ then the overall energy dispersion $D_e$ of the double focussing magnetic sector mass spectrometer is:

$$D_e = M_2 D_{e1} + D_{e2}$$

The electric sector may precede or follow the magnetic sector or alternatively two smaller electric sectors may be provided, one upstream and the other downstream of the magnetic sector. As long as the overall energy dispersion $D_e$ is zero then the arrangement may be considered as being a double focusing magnetic sector mass analyser. A combination of magnetic and electric sectors can be arranged which do not suffer from the image broadening problems associated with a single focusing magnetic sector mass spectrometers. Accordingly, double focusing magnetic sector mass spectrometers are capable of achieving much higher resolutions than single focusing magnetic sector mass spectrometers.

The combination of a magnetic sector and one or more electric sectors to provide a double focusing magnetic sector mass spectrometer allows sufficient degrees of freedom in the choice of design to allow relatively high order focusing to be achieved. Double focusing magnetic sector mass spectrometers in which all second order directional and energy focusing terms are approximately or substantially zero are known and such mass spectrometers can achieve resolving powers in excess of 150,000 according to the 10% valley definition (which is described in more detail below).

The mass resolution for a peak width in mass units of Δm, at mass m, is m/Δm. If the peak width $W_{pk}$ is measured at its base then theoretically the mass resolution m/Δm for an ion beam width $w_b$ and a collector slit width $w_c$ is given by:

$$\frac{m}{\Delta m} = \frac{D_m}{w_{pk}} = \frac{D_m}{(w_b + w_c)}$$

However, it is not practical to measure the peak width at its base and so conventionally the peak width is measured at 5% of the peak height. The peak width as measured at 5% of its height is used to calculate the resolution. This is known as the 10% valley definition of resolution since if two peaks of different mass, but equal intensity or height, were to overlap or intersect at a point equal to 5% of their height then the resultant peak profile would exhibit two peaks with a valley between them which is 10% of the height of either of the peaks. For example, if a magnetic sector mass spectrometer were to have a mass resolution of 1000 according to the 10% valley definition then two equal intensity peaks with masses 1000 and 1001 would be resolved such that the valley between the peaks of the resultant peak profile would be 10% of the height of either of the peaks.

As discussed above the spatial separation y of two ions having different masses of mean mass m and mass difference Δm is related to the dispersion coefficient $D_m$. This relationship can be used to express the real width of an ion beam $w_b$ at the collector slit in terms of the fractional mass difference of the ions Δm/m as follows:

$$\frac{\Delta m}{m} = \frac{w_b}{D_m}$$

The term for the fractional mass difference of the ions Δm/m is dimensionless and it is typically expressed in parts per million (ppm) where:

$$\frac{\Delta m}{m} = \frac{w_b}{D_m} \times 10^6 \text{ ppm}$$

Accordingly, the beam width $w_b$ may be expressed in ppm of mass when the dispersion coefficient $D_m$ of the mass spectrometer is known. The collector slit width $w_c$ may also be expressed in ppm of mass as follows:

$$\frac{\Delta m}{m} = \frac{w_c}{D_m} \times 10^6 \text{ ppm}$$

When an ion beam of width $w_b$ is swept across a collector slit of width $w_c$ and the transmitted ions are detected and recorded, then the recorded peak profile will have a width $W_{pk}$ where:

$$w_{pk} = w_b + w_c$$

The peak width $w_{pk}$ may also be expressed in terms of ppm of mass:

$$\frac{\Delta m}{m} = \frac{w_{pk}}{D_m} \times 10^6 \text{ ppm}$$

The inverse of mass resolution m/Δm of the mass analyser gives the mass resolving power Δm/m. Therefore, the mass resolving power can be considered as the peak width expressed in ppm of mass.

The capacity of double focusing magnetic sector mass spectrometers for high resolution results in their use for accurate mass measurements and for highly specific target compound trace analysis by a technique known as High Resolution Selective Ion Recording ("HR-SIR"). Conventional High Resolution Selective Ion Recording techniques use a double focusing magnetic sector mass spectrometer to select and record the response from target compounds at high resolution and with a high sensitivity. The high resolution enables background chemical masses to be effectively eliminated and consequently allows a lower detection level to be achieved. High Resolution Selective Ion Recording therefore provides a higher duty cycle and hence improved sensitivity compared with other conventional techniques.

The detection and quantification of polychlorinated dibenzo-p-dioxins, and in particular 2,3,7,8-tetrachlorinated dibenzo-p-dioxin ("2,3,7,8-TCDD") is a particularly important application of double focusing magnetic sector mass spectrometers. Despite extensive clean-up procedures, samples may still contain compounds such as polychlorinated biphenyls and benzylphenylethers which will have the same nominal masses as the compounds of interest. Samples are conventionally spiked with a known amount of a $^{13}C$ isotope labelled form of 2,3,7,8-tetrachlorinated dibenzo-p-dioxin introduced via gas chromatography and recorded by high resolution mass spectrometry. The measurement is quantified by comparison of the native dioxin response to that of the $^{13}C$ labelled form and verified by confirmation of the ratio of the major isotopes of both the native and the $^{13}C$ labelled dioxins. At a resolving power of 10,000 (10% valley definition) the conventional detection level for 2,3,7,8-tetrachlorinated dibenzo-p-dioxin is approximately 1 femto-gram, or 3 attomole, in the absence of other interfering components.

A magnetic sector mass spectrometer with a single ion detector may be used to record a mass spectrum by scanning and sequentially detecting different mass peaks. The duty cycle for recording each mass in the mass spectrum is generally relatively poor and the higher the resolution or the wider the mass range the poorer the duty cycle becomes. Unlike quadrupole mass filters, a magnetic sector mass analyser may be designed to record the signal from ions having several different masses simultaneously. This is commonly referred to as parallel detection.

Multiple detectors provide a means of accurately recording the relative abundance of two or more different masses simultaneously. The simultaneous accurate recording of the relative abundances of, for example, two isotopes is particularly accurate since this technique is substantially unaffected by fluctuations or drift in the ionisation source or in rapidly changing sample concentrations which is often encountered, for example, in chromatography. Magnetic sector mass spectrometers incorporating multiple collector slits and corresponding separate discrete ion detectors may therefore be used to make accurate isotope ratio determinations. Different ion detectors are required to record different masses but only at a low resolution of, for example, 200-300 (10% valley definition)

According to another conventional arrangement an array detector allows simultaneous acquisition over a range of masses thereby improving the duty cycle when used to record a mass spectrum. Array detectors employing high-density arrays of discrete charge sensitive detectors or single ion position sensitive detectors are very sensitive but are usually limited in size. Such array detectors are positioned along the focal plane of the mass spectrometer and therefore replace the collector slit which is otherwise normally used in conjunction with an ion detector in a magnetic sector mass spectrometer. Each separate detector in the array therefore substitutes for the collector slit and these separate detectors determine the resolution of the mass spectrometer. Since the detector is required to record several masses at the same time in practice it can only be operated at up to a medium resolution e.g. up to a resolution of about 2000 (10% valley definition). Such a resolution is still far too low for the analysis of polychlorinated dibenzo-p-dioxins.

Conventional High Resolution Selected Ion Recording techniques for the detection of traces of 2,3,7,8-tetrachlorinated dibenzo-p-dioxin involve repetitive rapid switching to at least four different masses at high resolution and recording the signal response for all four masses. This is commonly carried out at a mass resolution of around 10,000 (10% valley definition) to ensure that other isobaric components eluting from the gas chromatography column are separated out. In practice, an additional reference material is usually continuously infused into the ion source of the mass spectrometer so that an additional reference mass peak, which is close in mass to that of the trace compound to be analysed, is continuously present. The additional reference mass is included in the switching sequence so that any drift in the mass scale can be monitored and corrected for. The drift in the mass scale can be monitored by scanning across the reference peak to determine any shift in the peak centre. If drift in the mass scale is not monitored for then the switching to the peak top of each of the four masses of interest could not be performed with the necessary degree of certainty. It is also known to switch to the reference peak at a second time in each sequence to verify that the switching operation is working correctly and accurately. This procedure ensures accurate switching at a resolution of 10,000 (10% valley definition). However, although this procedure is sensitive it does not ensure that all of the ions detected are actually solely ions of the target compound of interest. Accordingly, interference ions may also be inadvertently detected.

Interference ions may be detected due to, for example, contamination materials in the ion source, reference material, bleed material from the gas chromatograph column, or other co-eluting components from the gas chromatograph which have very similar mass to charge ratios to the intended analyte ions. These interference ions may be detected because they may not be fully separated from the analyte ions even at a resolution of 10,000 (10% valley definition). Interference ions may also result from scattering due to ions from other components which are present at higher abundance colliding with residual gas molecules.

The main indication of the presence of a major interference is a distortion of the isotope ratio. Such a distortion is normally checked for as part of a standard verification procedure. However, even when interference ions are known to be present by recognising that the determined isotopic ratio is distorted, the presence of the interference ions will continue to contribute a background signal which may obscure the detection of the trace analyte ions of interest. Switching from peak top to peak top does not provide a way in itself of verifying whether the detected ions are actually the ions of interest nor does it help make a determination that the measured ion signal should be rejected due to the significant presence of interference ions.

It is therefore desired to provide an improved magnetic sector mass spectrometer.

According to the present invention there is provided a magnetic sector mass spectrometer comprising a magnetic sector mass analyser, a collector slit arranged downstream of the magnetic sector mass analyser and a device arranged downstream of the collector slit for dividing an ion beam transmitted through the collector slit into at least a first ion beam and a second ion beam. The mass spectrometer further comprises a first detector for measuring the intensity of at least a portion of the first ion beam and a second detector for measuring the intensity of at least a portion of the second ion beam.

The ion beam has a first direction and a second orthogonal direction. In the preferred embodiment the ions in the ion beam are dispersed according to their mass to charge ratio in the first direction so that the mass to charge ratio of ions in the ion beam varies along the first direction. Preferably, the ions in the ion beam are substantially not dispersed according to their mass to charge ratio in the second direction so that the mass to charge ratio of ions in the ion beam is substantially constant along the second direction.

In the preferred embodiment the first and second detectors measure the intensities of at least a portion of the first and second ion beams at substantially the same time.

The mass spectrometer may comprise a single focusing magnetic sector mass spectrometer or a double focusing magnetic sector mass spectrometer.

In the preferred embodiment the device for dividing the ion beam which is transmitted through the collector slit comprises an electrode. The electrode is maintained at a potential such that ions are reflected or deflected onto the first and second detectors. The electrode preferably comprises a finely edged blade or a wedge shaped electrode and, in use, analyte ions in the ion beam approaching the edge may be arranged such that they are disposed substantially uniformly and/or symmetrically relative to the edge. Interference ions in the ion beam approaching the edge of the electrode may be disposed substantially non-uniformly and/or asymmetrically relative to the edge.

The magnetic sector mass spectrometer preferably comprises an Electron Impact ("EI") ion source or a Chemical Ionisation ("CI") ion source. Alternatively, the ion source may be an Electrospray ("ESI") ion source, an Atmospheric Pressure Chemical Ionisation ("APCI") ion source, an Atmospheric Pressure Photo Ionisation ("APPI") ion source, a Matrix Assisted Laser Desorption Ionisation ("MALDI") ion source, a Laser Desorption Ionisation ("LDI") ion source, an Inductively Coupled Plasma ("ICP") ion source, a Fast Atom Bombardment ("FAB") ion source, a Liquid Secondary Ions Mass Spectrometry ("LSIMS") ion source, a Field Ionisation ("FI") ion source or a Field Desorption ("FD") ion source. The ion source may be a continuous or pulsed ion source.

Preferably, a voltage difference is maintained between the device for dividing the ion beam and the ion source. The voltage difference may be 0-100 V, 100-200 V, 200-300 V, 300-400 V, 400-500 V, 500-600 V, 600-700 V, 700-800 V, 800-900 V, 900-1000 V or more than 1000 V.

The preferred magnetic sector mass spectrometer may further comprise a processor for determining the intensity of at least a portion of the first ion beam relative to the intensity of at least a portion of the second ion beam. If the intensity of at least a portion of the first and/or second ion beam differs from the intensity of at least a portion of the second and/or first ion beam respectively by greater than or equal to a percent x, then a determination may be made that the ion beam includes a significant proportion of interference ions. Preferably, the percent x is selected from the group consisting of 1, 2, 3, 4, 5, 6, 7, 8, 9, 10, 15, 20, 25, 30, 35, 40, 45, 50, 55, 60, 65, 70, 75, 80, 85, 90, 95, 100 or more than 100. Alternatively, or in addition, if within a time t the number of ions detected by the first detector differs from the number of ions detected by the second detector by greater than or equal to y standard deviations of the total number of ions detected by the first and second detectors during the time t, then a determination may be made that the ion beam includes a significant proportion of interference ions. Preferably, the number of standard deviations y is selected from the group consisting of 0.25, 0.5, 0.75, 1.0, 1.25, 1.5, 1.75, 2.0, 2.25, 2.5, 2.75, 3.0, 3.25, 3.5, 3.75, 4.0 or more than 4.0.

In a preferred embodiment the signals from the first and second detectors are summed to produce a combined signal and the combined signal may be multiplied by a weighting factor. Preferably, the weighting factor does not substantially attenuate the combined signal when the signal from the first detector substantially equals the signal from the second detector. Additionally, or alternatively, the weighting factor may substantially attenuate the combined signal when the signal from the first detector substantially differs from the signal from the second detector. In one embodiment the weighting factor is of the form $\exp(-ky^n)$, where k and n are constants and within a time t the number of ions detected by the first detector differs from the number of ions detected by the second detector by y standard deviations of the total number of ions detected by the first and second detectors during the time t. In this embodiment the difference between the number of ions detected by the first and second detectors is taken as a positive value, i.e. the modulus of the difference between the number of ions detected. Preferably, the constant k is 0.5-2.0, 0.6-1.8, 0.7-1.6, 0.8-1.4, 0.9-1.2, 0.95-1.1 or 1. Preferably, the constant n is 1.0-3.0, 1.2-2.8, 1.4-2.6, 1.6-2.4, 1.8-2.2, 1.9-2.1 or 2.

In the preferred embodiment, if a determination is made that the ion beam includes a significant proportion of interference ions then signals from the first and/or second detectors are discarded or are otherwise deemed to be relatively inaccurate. Alternatively, if a determination is made that the ion beam does not include a significant proportion of interference ions then signals from the first and second detectors are summed or are otherwise deemed to be relatively accurate.

Preferably, the magnetic sector mass spectrometer further comprises a lens arranged downstream of the collector slit. The lens may refocus the image of the collector slit onto the device for splitting the ion beam or may substantially collimate the ion beam.

In another embodiment a screening tube is provided for guiding ions onto the device for splitting the ion beam. The screening tube is preferably arranged between the collector slit and the device for splitting the ion beam and may shield the ion beam from the voltages applied to the first and/or second detector. Preferably, the first and/or second detector comprises one, two, three, four, five, six, seven, eight, nine, ten or more than ten microchannel plate detectors. Additionally, or alternatively, the first and/or second detector may comprise one, two, three, four, five, six, seven, eight, nine, ten or more than ten conversion dynode(s) for generating electrons in response to ions impinging upon said conversion dynode(s). The mass spectrometer may additionally comprise one or more electron multipliers and/or one or more microchannel plate detectors for receiving electrons generated by the conversion dynode(s). In another embodiment, the mass spectrometer further comprises one or more scintillators and/or one or more phosphers upon which the electrons generated by the conversion dynode(s) are received such that the one or more scintillators and/or the one or more phosphers generate photons in response to receiving electrons. The mass spectrometer may also comprise one or more photo-multiplier tubes and/or one or more photo-sensitive solid state detectors for detecting the photons.

In the preferred embodiment, the magnetic sector mass spectrometer further comprises an additional detector arranged upstream of the first and second detectors. This additional detector may comprise a conversion dynode and in a mode of operation at least a portion of an ion beam is deflected onto the conversion dynode of the additional detector such that the conversion dynode generates electrons in response thereto. The additional detector may further comprise one or more electron multipliers and/or one or more microchannel plate detectors for receiving the electrons generated by the conversion dynode. One or more scintillators and/or one or more phosphers may also be provided to receive electrons generated by the conversion dynode and generate photons in response thereto. These photons may be detected by one or more photo-multiplier tubes and/or one or more photo-sensitive solid state detectors.

Preferably, the gain of the first and/or second detector can be independently adjusted and in one embodiment the first and second detectors are powered by independently adjustable power supplies. The first and second detectors may further comprise one or more Analogue to Digital Converters and/or one or more ion counting detectors.

In another preferred embodiment the magnetic sector mass spectrometer further comprises adjustment means for centering the ion beam onto the device for splitting the ion beam. The adjustment means preferably comprises at least one deflecting electrode downstream of the collector slit which is arranged to move the ion beam relative to the device for splitting the ion beam.

The magnetic sector mass spectrometer according to the preferred embodiment is particularly suitable for target compound trace analysis.

From another aspect the present invention provides a method of mass spectrometry. The method comprises transmitting an ion beam through a magnetic sector mass analyser and a collector slit arranged downstream of the magnetic sector mass analyser, dividing the ion beam downstream of the collector slit into at least a first ion beam and a second ion beam, measuring the intensity of at least a portion of the first ion beam with a first detector and measuring the intensity of at least a portion of the second ion beam with a second detector.

The ion beam has a first direction and a second orthogonal direction. In the preferred method the ions in the ion beam are dispersed according to their mass to charge ratio in the first direction so that the mass to charge ratio of ions in the ion beam varies along the first direction. Preferably, the ions in the ion beam are substantially not dispersed according to their mass to charge ratio in the second direction so that the mass to charge ratio of ions in the ion beam is substantially constant along the second direction.

In the preferred embodiment the first and second detectors measure the intensities of at least a portion of the first and second ion beams at substantially the same time. The method preferably further comprises determining the intensity of at least a portion of the first ion beam relative to the intensity of at least a portion of the second ion beam. Preferably, if the intensity of at least a portion of the first and/or second ion beam differs from the intensity of at least a portion of the second and/or first ion beam respectively by a greater than or equal to a percent x, then a determination may be made that the ion beam includes a significant proportion of interference ions. The percent x may be 1, 2, 3, 4, 5, 6, 7, 8, 9, 10, 15, 20, 25, 30, 35, 40, 45, 50, 55, 60, 65, 70, 75, 80, 85, 90, 95, 100 or greater than 50. Alternatively, or in addition if within a time t the number of ions detected by the first detector differs from the number of ions detected by the second detector by greater than or equal to y standard deviations of the total number of ions detected by the first and second detectors during the time t, then a determination may be made that the ion beam includes a significant proportion of interference ions. Preferably, the number of standard deviations y is 0.25, 0.5, 0.75, 1.0, 1.25, 1.5, 1.75, 2.0, 2.25, 2.5, 2.75, 3.0, 3.25, 3.5, 3.75, 4.0 or greater than 4.0.

In a preferred embodiment the method further comprises summing signals from the first and second detectors to produce a combined signal and multiplying the combined signal by a weighting factor. Preferably, the weighting factor does not substantially attenuate the combined signal when the signal from the first detector substantially equals the signal from the second detector. Additionally, or alternatively, the weighting factor may substantially attenuate the combined signal when the signal from the first detector substantially differs from the signal from the second detector. In one embodiment the weighting factor is of the form $\exp(-ky^n)$, where k and n are constants and within a time t the number of ions detected by the first detector differs from the number of ions detected by the second detector by y standard deviations of the total number of ions detected by the first and second detectors during the time t. In this embodiment the difference between the number of ions detected by the first and second detectors is taken as a positive value. Preferably, the constant k is 0.5-2.0, 0.6-1.8, 0.7-1.6, 0.8-1.4, 0.9-1.2, 0.95-1.1 or 1. Preferably, the constant n is 1.0-3.0, 1.2-2.8, 1.4-2.6, 1.6-2.4, 1.8-2.2, 1.9-2.1 or 2.

In the preferred method, if a determination is made that the ion beam includes a significant proportion of interference ions then the signals from the first and/or second detectors may be discarded or are otherwise deemed to be relatively inaccurate. Alternatively, if a determination is made that the ion beam does not include a significant proportion of interference ions then signals from the first and second detectors may be summed or otherwise deemed to be relatively accurate.

Various embodiments of the present invention together with other arrangements given for illustrative purposes only, will now be described, by way of example only, and with reference to the accompanying drawings in which.

FIG. 11 illustrates the effect of a small shift in the position of an ion beam comprising 20 ions incident upon the collector slit of an ion detector according to the preferred embodiment having a high resolution of 10,000; and FIG. 12 illustrates the effect of a small shift in the position of an ion beam comprising 100 ions incident upon the collector slit of an ion detector according to the preferred embodiment having a low resolution of 2000.

Figure 1:
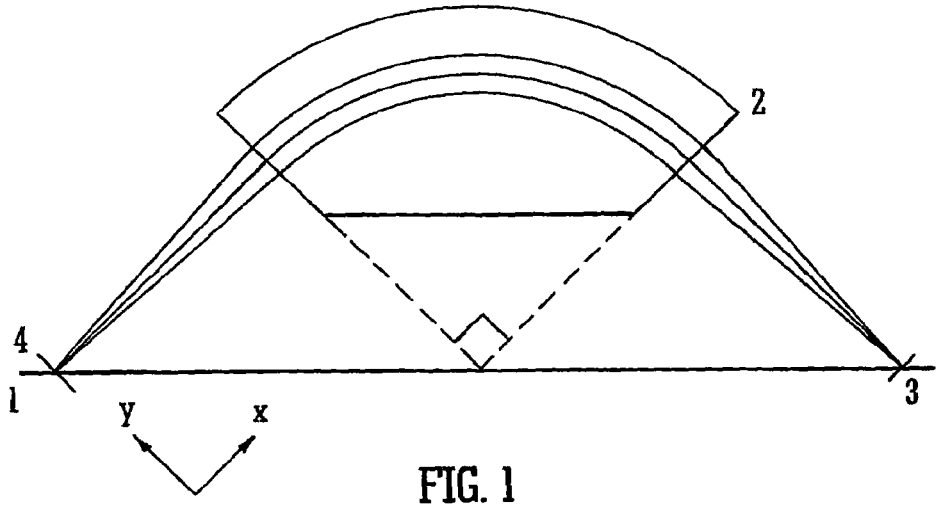
FIG. 1 PRIOR ART
FIG. 1 shows a conventional single focusing magnetic sector mass spectrometer.

A conventional single focusing magnetic sector mass spectrometer is shown in FIG. 1. The mass spectrometer comprises an ion source 1, a magnetic sector mass analyser 2 and a collector slit 3 arranged immediately upstream of an ion detector (not shown). The ion source 1 has a slit 4 which defines the width of an ion beam emerging from the ion source 1. The magnetic sector mass analyser 2 shown in FIG. 1 has convergent directional focusing characteristics. An ion collector slit 3 is positioned at the image point of the ion source slit 4 so that a single focusing magnetic sector mass spectrometer is provided. Although the directional focusing characteristics of the single focusing magnetic sector mass spectrometer can be designed to a very high order, its imaging properties will be limited by any spread in the energies of the ions emitted from the ion source 1.

Figure 2:
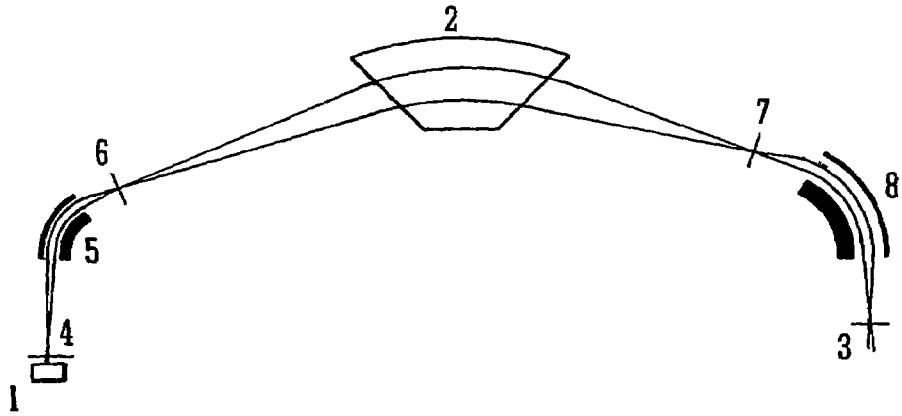
FIG. 2 PRIOR ART
FIG. 2 shows a conventional double focusing magnetic sector mass spectrometer.

FIG. 2 shows a conventional double focussing mass spectrometer. The mass spectrometer comprises an ion source 1 having a source slit 4. Ions from the ion source 1 pass through a first electric sector 5 and are brought to a first intermediate image 6. The ions then pass through the magnetic sector mass analyser 2 and are brought to a second intermediate image 7 before passing through a second electric sector 8 prior to the ions being focused onto a collector slit 3. The electric sectors 5,8 serve to reduce the dispersion of the ions with different energies which would otherwise cause the image width to be broadened and which would hence limit the resolution of the mass spectrometer.

Figure 3:
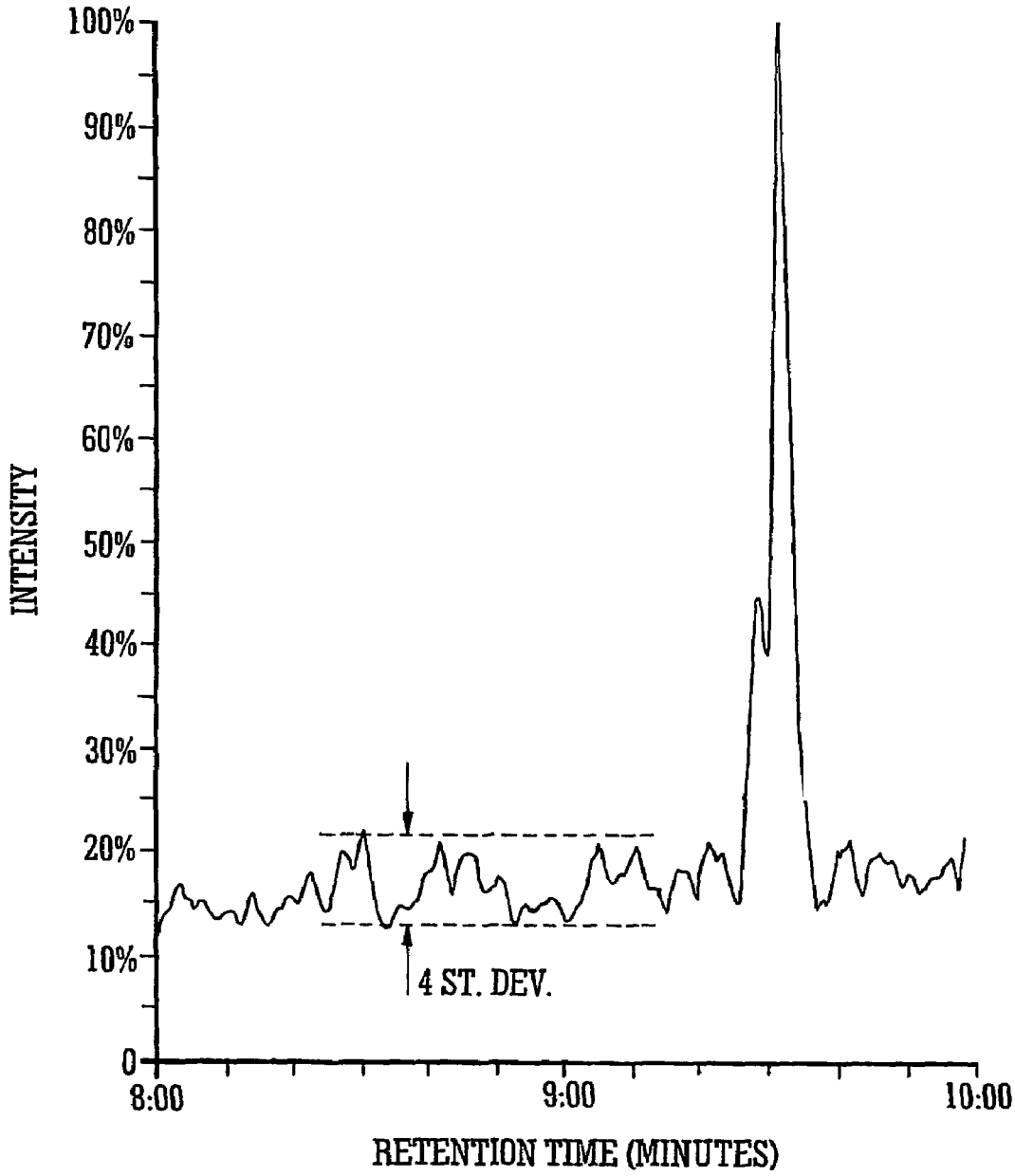
FIG. 3 PRIOR ART
FIG. 3 shows a conventional measurement of 2,3,7,8-tetrachlorinated dibenzo-p-dioxin obtained by High Resolution Selective Ion Recording.

FIG. 3 shows a conventional measurement of the signal intensity as a function of retention time in a gas chromatograph for a solution containing 5 fg of 2,3,7,8-tetrachlorinated dibenzo-p-dioxin analysed using a conventional double focussing magnetic sector mass spectrometer having a resolving power of 10,000 (10% valley definition) and set to monitor ions having a molecular weight of 321.8936. From this measurement it can be seen that the detection level for 2,3,7,8-tetrachlorinated dibenzo-p-dioxin is limited by the noise created by other ions passing through the collector slit, some of which will be compounds which have the same nominal mass as the analyte. In this example it can be seen that the detection level is limited to approximately 1 fg (3 atto-mole).

A preferred embodiment of the present invention will now be described with reference to FIGS. 4 and 5. A mass spectrometer according to the preferred embodiment comprises a split ion detector 11 having two or more separate detectors 14*a*,14*b* which are provided in conjunction with a single collector slit 3 (see FIG. 5). Ions which are transmitted through the single collector slit 3 pass into the split ion detector 11 and are divided in the direction of mass dispersion by a reflecting electrode 13 to one side or the other of the reflecting electrode 13 depending upon the position of the ions and the direction in which the ions are heading. The ions reflected by the reflecting electrode 13 are directed onto one of two or more detectors 14*a*,14*b*.

An ion beam which is uniformly distributed across the collector slit 3 and/or which is distributed symmetrically about the centre of the collector slit 3 will be divided substantially equally so that substantially half of the ions in the ion beam will be reflected by the reflecting electrode 13 so that they are incident upon one of the detectors 14*a*;14*b* whilst the other half of the ions in the ion beam will be reflected by the reflecting electrode 13 so that they are incident upon the other detector 14*a*;14*b*. Conversely, an ion beam which is not uniformly distributed across the collector slit 3 and/or which is not distributed symmetrically about the centre of the collector slit 3 will be divided by the electrode 13 unequally so that the signal from the two detectors 14*a*,14*b* will be substantially different.

According to the preferred embodiment the collector slit 3 is precisely positioned so that only analyte ions of interest will be distributed uniformly across the collector slit 3 and/or will be distributed symmetrically about the centre of the collector slit 3. Accordingly, only analyte ions of interest will be distributed uniformly and/or symmetrically across the reflecting electrode 13 and hence substantially 50% of the analyte ions of interest will be incident upon one of the detectors 14*a*;14*b* whilst substantially 50% of the analyte ions will be incident upon the other detector 14*a*;14*b*. However, interference ions will pass through the magnetic sector mass analyser on slightly different trajectories and hence will not be distributed uniformly or symmetrically across the collector slit 3. Accordingly, the interference ions will not therefore be distributed uniformly or symmetrically across the reflecting electrode 13, and hence the interference ions will not be distributed equally between the two detectors 14*a*,14*b*. It therefore follows that the ion signals from the two detectors 14*a*,14*b* will be substantially different. Therefore, by measuring the relative intensity of the signals from the two detector 14*a*,14*b* it is possible to determine whether or not the total ion beam is uniformly distributed across the collector slit 3 and/or whether or not the ion beam is distributed symmetrically about the centre of the collector slit 3. This in turn enables a determination to be made as to whether or not the detected ion beam includes a significant proportion of interference ions. If the signals from the two ion detectors 14*a*,14*b* are substantially identical then the signals can be summed and recorded, otherwise the signals can be ignored or discarded. Alternatively, the signals from the two ion detectors may be summed and multiplied by a weighting factor preferably in the form $\exp(-ky^n)$ where k is preferably 1, n is preferably 2 and y is the standard deviations of the total number of ions detected by the first and second detectors during a time t. The weighting factor preferably has the effect of retaining the significance of the summed signals when the signals are substantially similar and attenuating or otherwise substantially suppressing the significance of the summed signals when the signals differ in intensity significantly.

The reflecting electrode 13 preferably comprises a finely edged blade or wedge shaped electrode. The reflecting electrode 13 is preferably arranged substantially perpendicular to the plane of the collector slit 3 and substantially parallel to the direction of the magnetic fields such that it divides the ion beam in the direction of mass dispersion. The ion beam is preferably divided into two separate ion beams which are then directed onto two or more detectors 14*a*,14*b*. A high voltage relative to the ion source is preferably applied to the reflecting electrode 13 so that ions are repelled away from the reflecting electrode 13 and peel off to one side or the other depending upon which side of the dead centre of the blade electrode 13 the ion is positioned and heading. Adjustment of either the ion beam and/or the reflecting electrode 13 is preferably possible such that the ion beam may be aligned with the centre of the collector slit 3 and such that ions in the centre of the ion beam are precisely directed towards the beam dividing edge of the reflecting electrode 13. All of the ions which pass into the split ion detector 11 are preferably deflected to one side or the other of the reflecting electrode 13 such that the ions are detected by two or more detectors 14*a*,14*b*.

Figure 4:
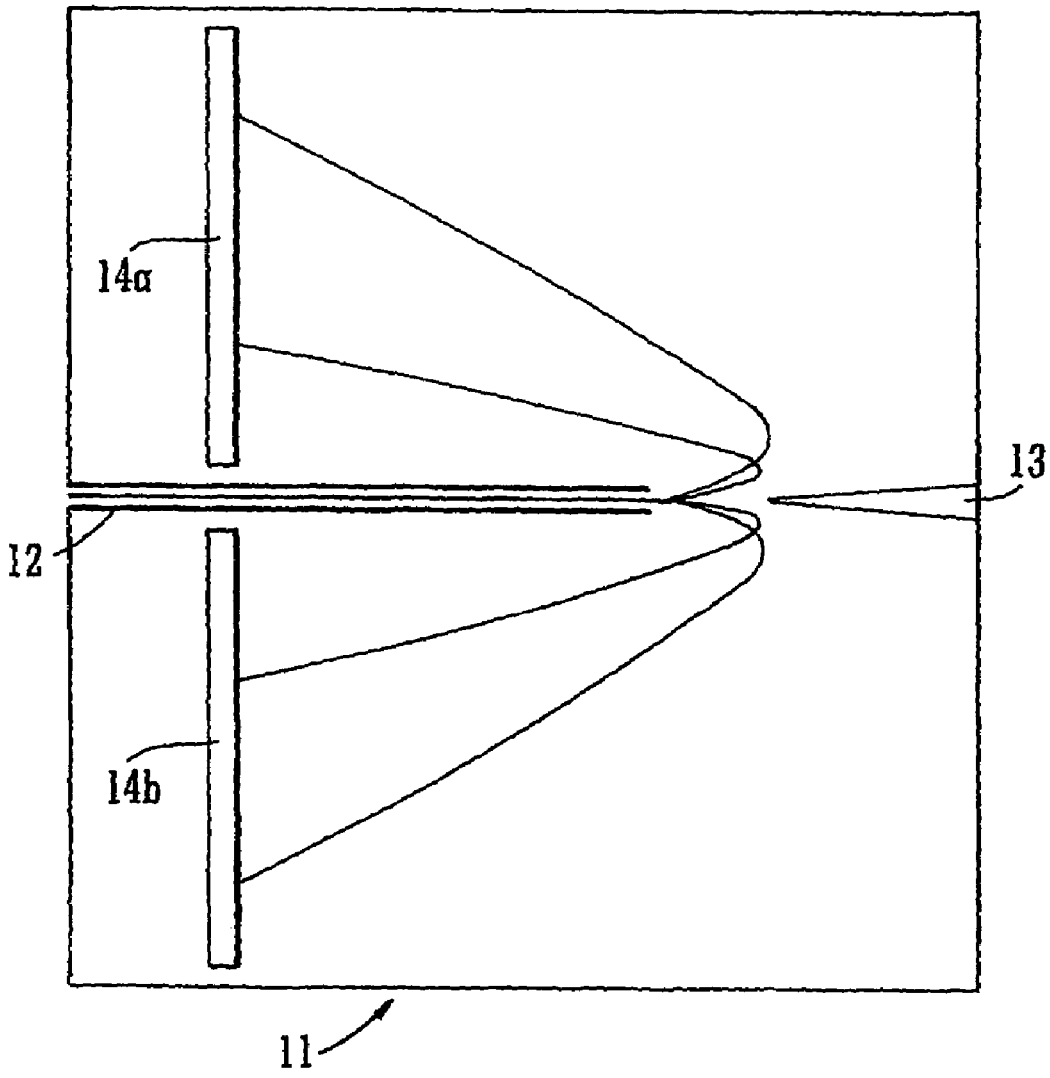
FIG. 4 shows an ion detector according to a preferred embodiment of the present invention.

Ions preferably enter the split ion detector 11 through a screening tube 12 (as shown in FIG. 4) and emerge from the screening tube 12 to preferably immediately confront the reflecting electrode 13. The screening tube 12 preferably acts to at least partially, preferably substantially, shield the ions passing through the split ion detector 11 from any electric fields resulting from voltages applied to the detectors 14*a*, 14*b*. The retarding electric fields generated by the reflecting electrode 13 cause the ions to peel off and be reflected back to the two or more detectors 14*a*,14*b* arranged either side of the screening tube 12. The two detectors 14*a*,14*b* preferably comprise microchannel plates having anodes positioned behind the microchannel plates. Each ion that arrives at one of the microchannel plates results in the generation of a pulse of electrons which is released such that the electrons are received on the anode behind the microchannel plate. Each pulse of electrons which are incident on the anode may be counted or integrated and then measured using an Analogue to Digital Converter. The ion detectors 14*a*,14*b* may include discrete dynode electron multipliers or continuous dynode channeltrons as described in more detail below.

Figure 5:
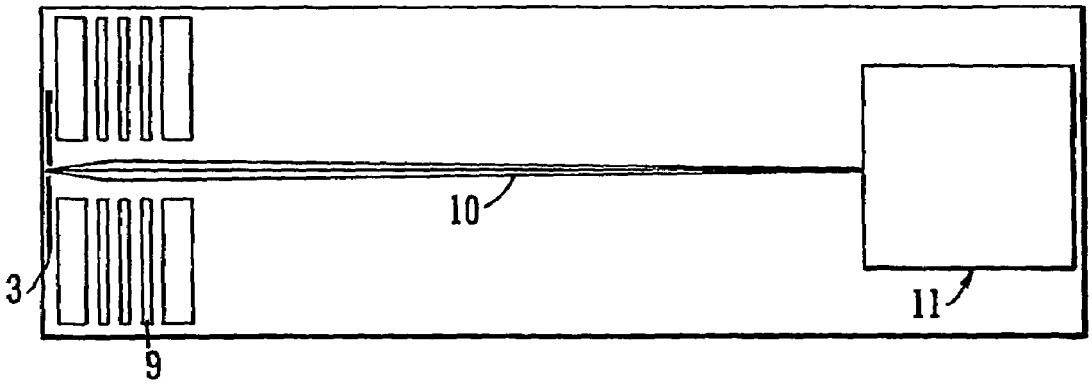
FIG. 5 shows an embodiment wherein a lens is used to focus an ion beam which has passed through a collector slit onto the entrance aperture of an ion detector according to the preferred embodiment.

FIG. 5 shows in more detail the portion of the mass spectrometer intermediate the collector slit 3 and the split ion detector 11 according to an embodiment of the present invention. A lens 9 is preferably provided downstream of the collector slit 3 and upstream of the split ion detector 11. The lens 9 preferably refocuses the image of the collector slit 3 onto the entrance to the split ion detector 11. Preferably, the refocused image of the collector slit 3 is magnified such as to increase the spatial distribution of the ions passing through the collector slit 3 and arriving at the split ion detector 11.

Figure 6:
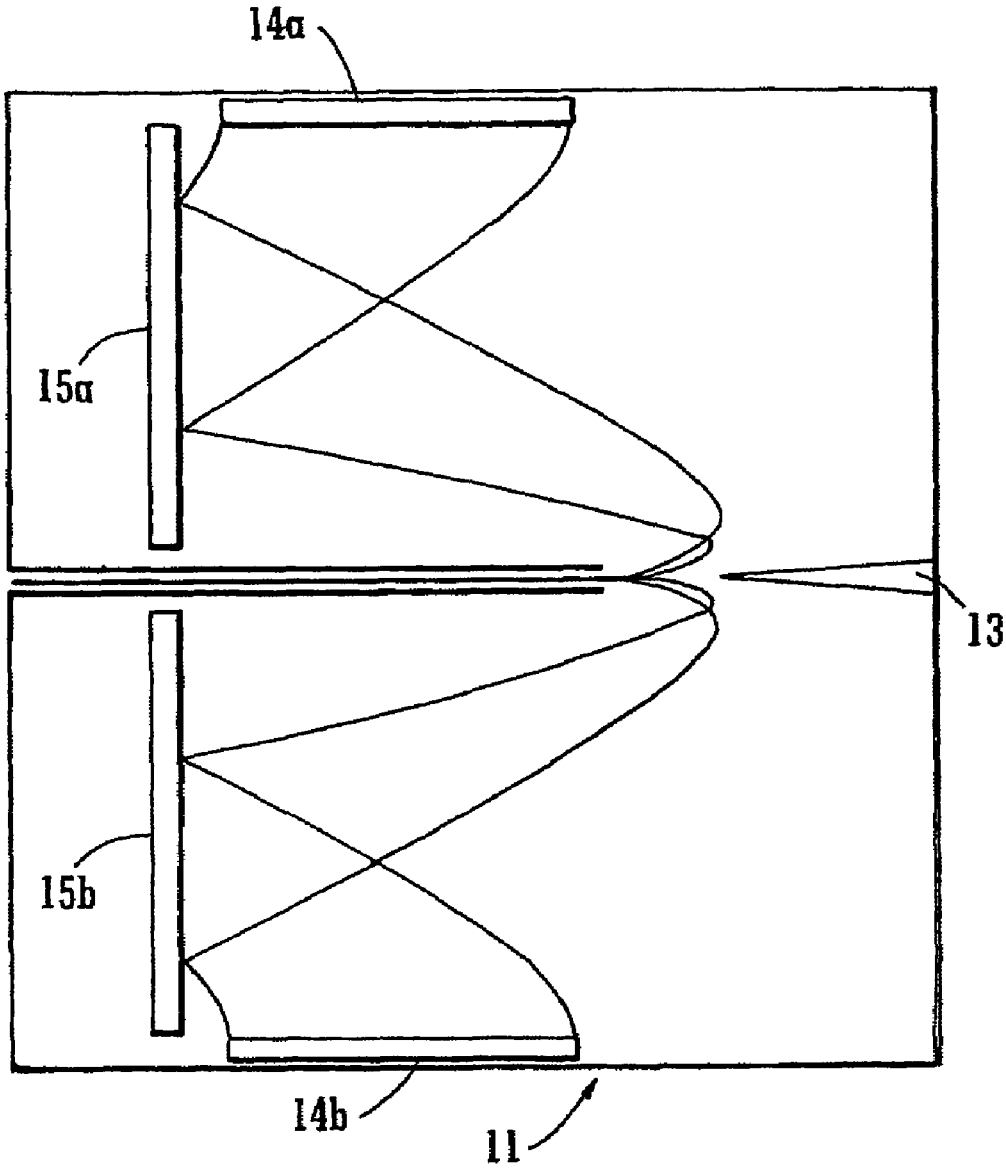
FIG. 6 shows a particularly preferred embodiment wherein ions are detected using conversion dynodes in combination with microchannel plate detectors.

FIG. 6 illustrates a particularly preferred embodiment of the present invention wherein ions reflected by the reflecting electrode 13 are accelerated towards and onto two conversion dynodes 15*a*,15*b*. Ions striking the conversion dynodes 15*a*, 15*b* cause the conversion dynodes 15*a*, 15*b* to generate secondary electrons. The resulting secondary electrons are then detected using two detectors 14*a*,14*b* which preferably comprise microchannel plate ion detectors. An advantage of using conversion dynodes 15*a*,15*b* to initially detect the ions rather than microchannel plates is that the efficiency of ion detection can be increased to near 100%. A microchannel plate typically has an effective ion receiving area of 60-70% upon which an ion impinging will result in the production of secondary electrons. Therefore, the ion detection efficiency of a microchannel plate is effectively limited to approximately 60-70%. In contrast, conversion dynodes 15*a*,15*b* have an ion detection efficiency of approximately 100% and typically will yield between two and six electrons per ion incident upon the respective conversion dynode 15*a*,15*b*. Accordingly, the probability that the microchannel plates 14a,14b arranged as shown in FIG. 6 will detect at least one of the secondary electrons generated and released by the conversion dynodes 15*a*,15*b* in response to an ion impacting upon the conversion dynode 15*a*,15*b* is virtually 100%.

According to another less preferred embodiment ions may be accelerated from the conversion dynodes 15*a*,15*b* and be received on one or more scintillators and/or one or more phosphors (not shown). The resulting photons may then preferably be detected using one or more photo-multiplier tubes ("PMT") and/or one or more photosensitive solid state detectors (not shown).

Figure 7:
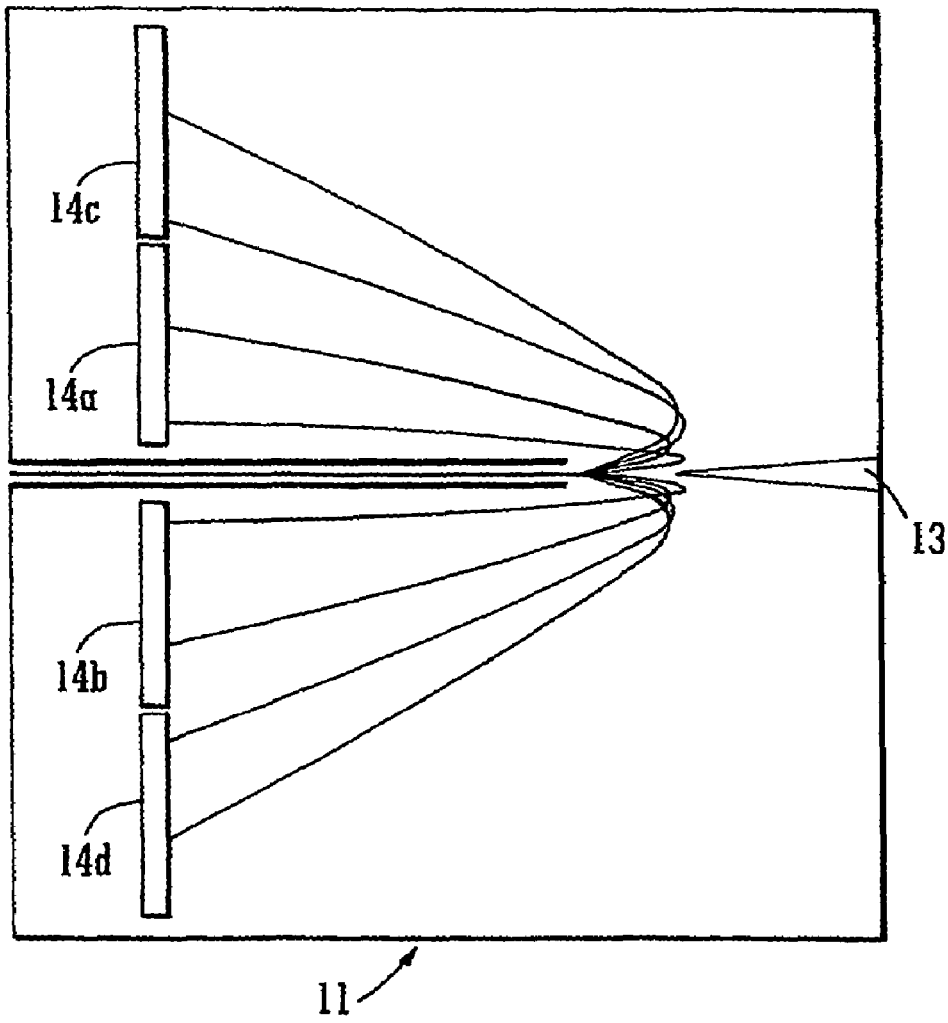
FIG. 7 shows another embodiment wherein two detectors are provided on each side of a reflecting electrode.

FIG. 7 illustrates a further embodiment wherein two detectors 14*a*,14*c*;14*b*,14*d* are positioned on each side of the reflecting electrode 13 so that a total of four ion detectors are provided. In this embodiment a portion of an ion beam which is defected to one side of the central reflecting electrode 13 will be received upon two ion detectors 14*a*,14*c*. Similarly, the portion of the ion beam deflected to the other side of the central reflecting electrode 13 will be received upon two other detectors 14*b*,14*d*. This embodiment allows any asymmetry of the ion beam with respect to the reflecting electrode 13 (and hence collector slit 3) to be more accurately determined. It is contemplated that according to further unillustrated embodiments six, eight, ten, twelve or any number of further ion detectors may be provided.

Figure 8:
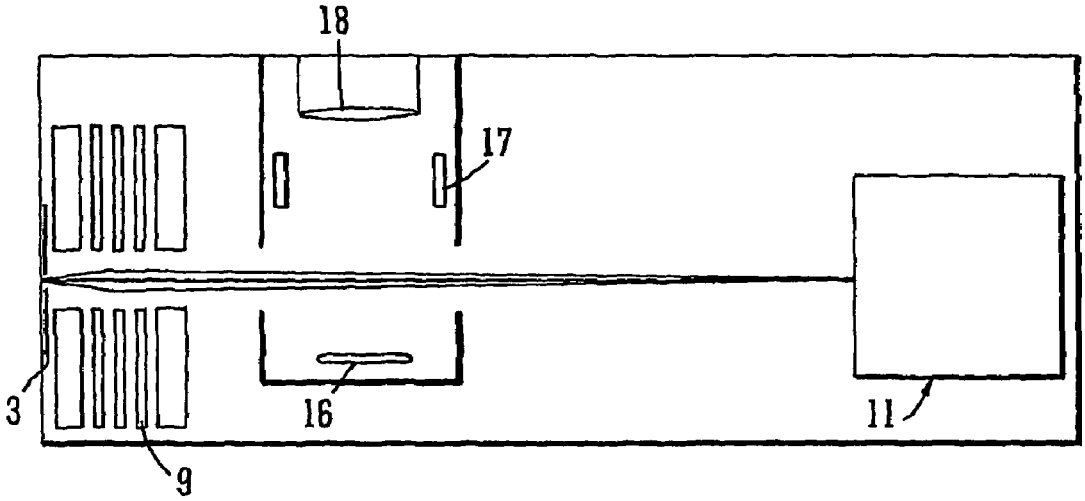
FIG. 8 shows an embodiment wherein in a mode of operation ions may be directed onto a preferred ion detector and wherein in another mode of operation ions may be deflected onto a second detector system.

FIG. 8 illustrates a further embodiment wherein the preferred split ion detector 11 is provided downstream of a second detector system 16,17,18. The second detector system 16,17,18 is preferably provided off-axis with respect to the ion beam so that neutral particles in the ion beam preferably do not interfere with the second detector system 16,17,18.

In this embodiment the upstream ion detector preferably comprises a conversion dynode 16, one or more focusing ring electrodes 17, a scintillator (or phosphor) and a photo-multiplier 18. When the voltages applied to the second detector system are switched OFF the ions travel directly past the second detector system onto the preferred split ion detector 11 without interruption. When the voltages applied to the second detector system are switched ON then ions are preferably deflected onto the conversion dynode 16. Ions strike the conversion dynode 16 and cause secondary electrons to be released which are then preferably accelerated and focused onto the scintillator or phosphor 18 by the one or more ring lenses 17. Alternatively, the ions may be deflected directly onto a microchannel plate detector (not shown).

In an alternative embodiment the preferred split ion detector 11 and the second detection system 16,17,18 may be arranged such that ions may be directed to one or other of the two detectors by an electrostatic and/or magnetic field.

In a further embodiment, in one mode of operation substantially all of the ions may be directed onto one of the detectors 14*a*,14*b*,14*c*,14*d* of the preferred split ion detector 11 by an electric and/or magnetic field.

When an ion beam comprising ions having a specific mass to charge ratio is scanned across the collector slit 3 the resulting signal profile is commonly referred to as the peak profile. As the ion beam is scanned across the collector slit 3 ions will begin to be onwardly transmitted to the ion detector when the leading edge of the ion beam reaches a first edge of the collector slit 3. Ions will then continue to be transmitted through the collector slit 3 and to the ion detector until the trailing edge of the ion beam arrives at the second opposite edge of the collector slit 3. Accordingly, the width of the peak profile will be the width $w_b$ of the ion beam summed with the width $w_e$ of the collector slit. If the width $w_b$ of the ion beam is substantially equal to the width $w_c$ of the collector slit 3 then the peak profile will have a maximum corresponding to when the ion beam is symmetrically distributed about the centre of the collector slit 3. The peak profile will vary depending upon the relative width $w_b$ of the ion beam and the width $w_c$ of the collector slit 3. The peak profile will also vary depending upon the ion intensity profile of the ion beam.

High Resolution Selected Ion Recording measurements, as described above for the detection of traces of 2,3,7,8-tetrachlorinated dibenzo-p-dioxin, are commonly carried out at a mass resolution of 10,000 (10% valley definition). A mass peak that has a width of 100 ppm of the mass when measured at 5% of the maximum intensity will have a mass resolution of 10,000 (10% valley definition). A mass peak that is 100 ppm wide will usually have maximum transmission when the collector slit width $w_c$ is just equal to that of the ion beam width $w_b$ i.e. when the collector slit 3 and the ion beam each have a width of 50 ppm. Under these conditions the source slit width $w_s$ is as large as it can be for the collector slit 3 to just transmit the total beam arriving at the collector slit 3 and for the peak width ($w_b$+$w_c$) of 100 ppm.

Figure 9:
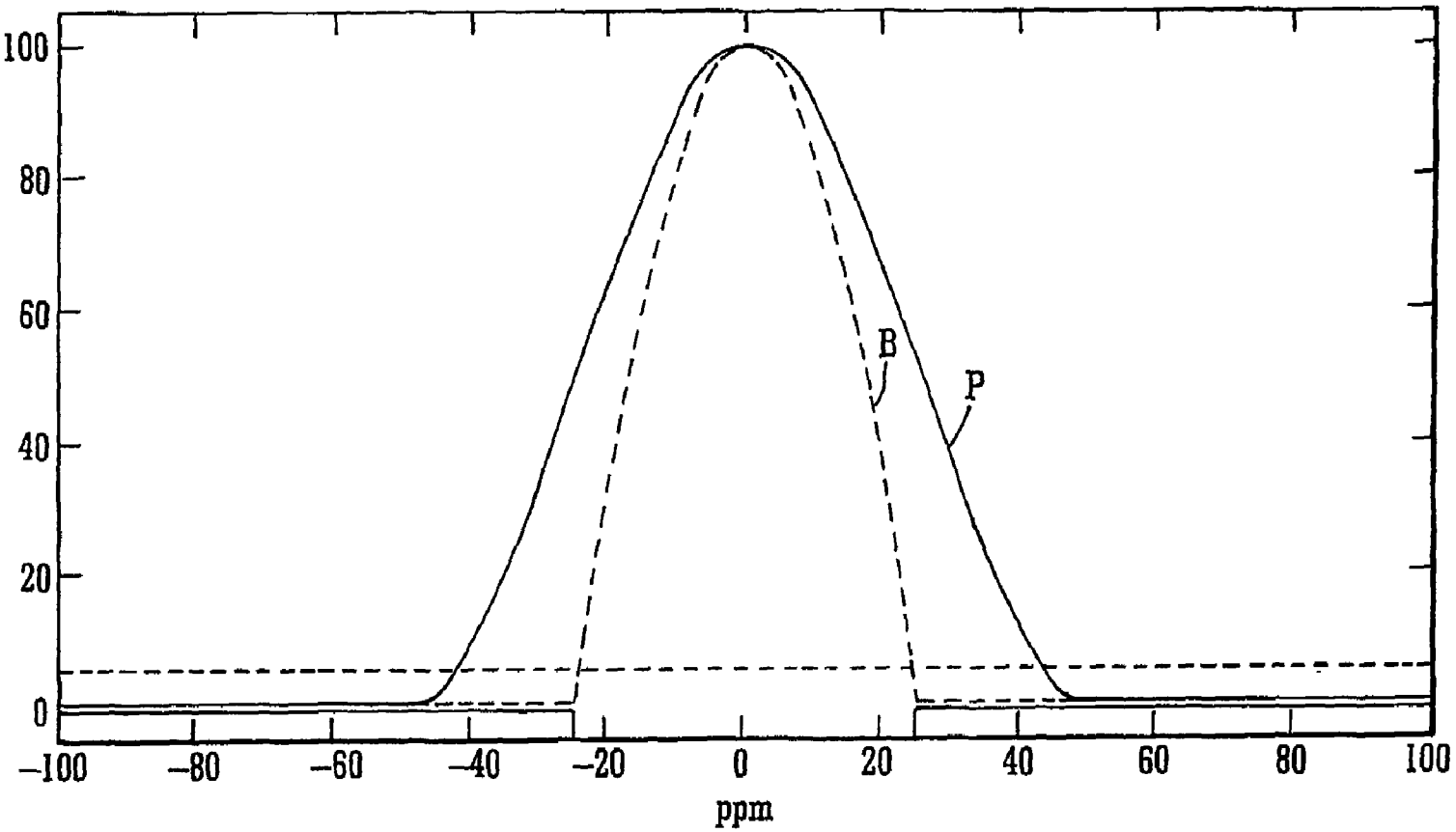
FIG. 9 PRIOR ART
FIG. 9 illustrates a typical peak profile which may be observed using a conventional ion detector.

FIG. 9 shows an example of the peak profile P obtained when an ion beam B having a beam width $w_b$ of 50 ppm is scanned across a collector slit 3 having a width $w_c$ of 50 ppm. The resulting observed peak profile P will have a width of 100 ppm and will have a maximum corresponding to when the ion beam is centred on the collector slit 3. The ion beam profile B is shown at a position centred on the collector slit 3. The ion beam profile B may vary according to a number of parameters in the design of the mass spectrometer although a typical beam profile may follow a cosine distribution. In the example illustrated in FIG. 9 the ion beam profile B has a cosine distribution and the resulting observed peak profile P detected by a conventional single ion detector has a cosine squared distribution.

In High Resolution Selected Ion Recording experiments the ion beam is switched to a central position where substantially 100% of the ion beam is transmitted through a collector slit of the mass spectrometer. Since the ion beam is not scanned across the collector slit then this approach does not allow any knowledge of the peak profile to be gained. The peak profile can only be assumed to be that as shown, for example, by P in FIG. 9. If the peak profile is not as expected, for example, due to the peak not having precisely the right mass to charge ratio or because the peak includes the measurement of randomly scattered ions having very slightly differing mass to charge ratios then this will not be known and the interference ions will be included in the measurement of the analyte ions. If, however, the ion beam that is transmitted through the collector slit is split into two or more ion beams which are detected on two or more detectors as according to the preferred embodiment then the situation is quite different as will be shown in more detail below.

Figure 10:
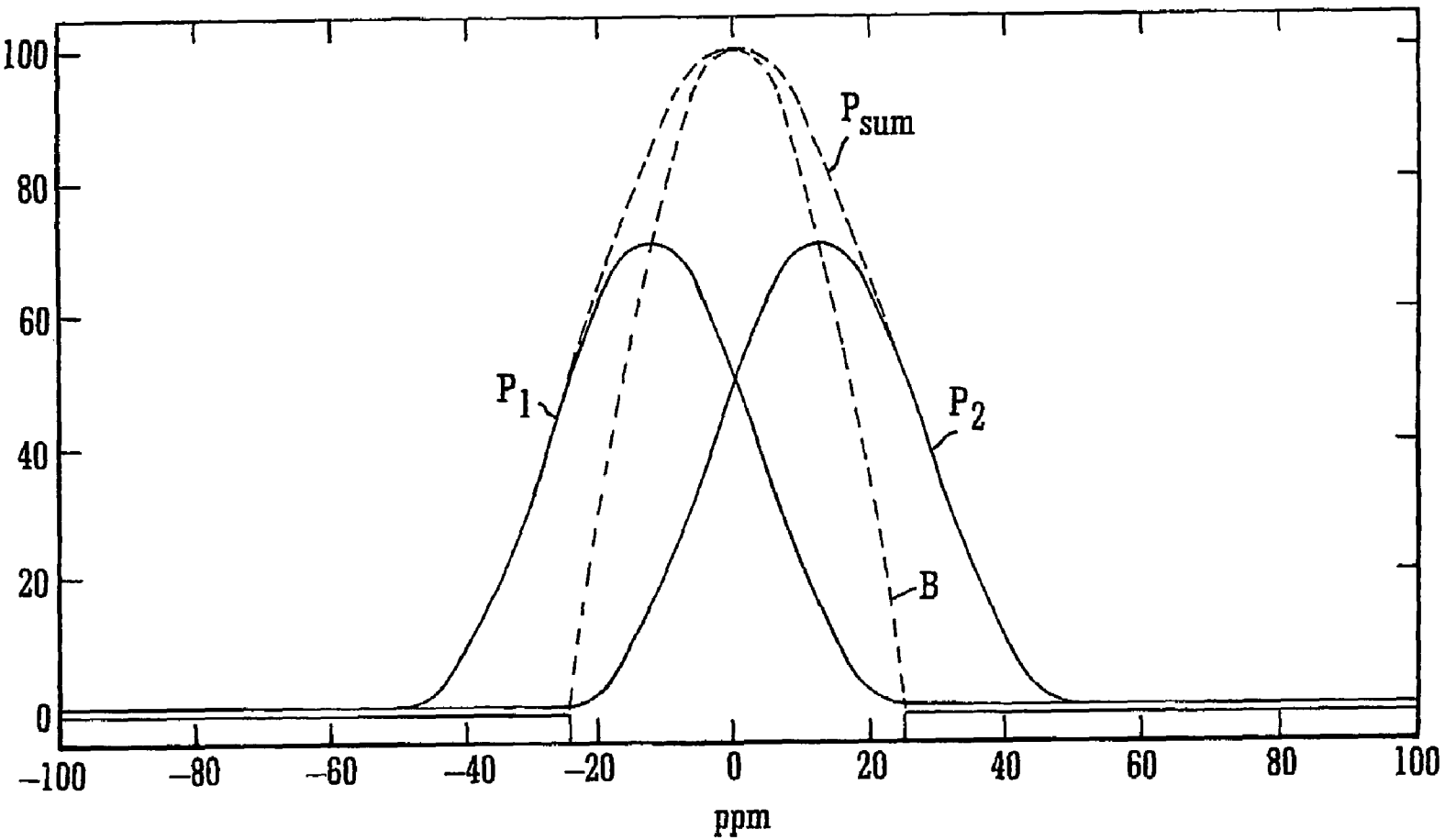
FIG. 10 illustrates the peak profiles which may be observed using an ion detector according to the preferred embodiment.

FIG. 10 shows an example of the peak profiles $P_1$,$P_2$,$P_{sum}$ which will be observed where an ion beam having a profile B and a width $w_b$ of 50 ppm is incident upon a collector slit 3 having a width $w_c$ of 50 ppm and is detected using a split ion detector 11 according to the preferred embodiment. The resulting peak profiles $P_1$,$P_2$ recorded on the two detectors of the preferred split ion detector 11 are each 75 ppm wide and are displaced by 25 ppm with respect to each other. If the two peak profiles $P_1$,$P_2$ are summed then the resulting peak profile $P_{sum}$ will be 100 ppm wide and will have substantially the same profile as that recorded on a conventional single ion detector as shown in FIG. 9.

In a High Resolution Selected Ion Recording experiment wherein the ion beam is switched to the central position, the ion signal recorded on each of the two detectors of the preferred split ion detector 11 will be substantially the same provided that the ion beam is symmetrically disposed about the centre of the collector slit 3. If, however, the peak profile is not as expected because, for example, the ions include interference scattered ions having slightly different mass to charge ratios or because the ions include randomly scattered ions having similar mass to charge ratios, then the ion signals detected by the two detectors of the preferred split ion detector 11 will not be equal. Therefore, the split ion detector 11 of the preferred embodiment enables a determination to be made as to whether or not (and indeed to what extent) interference ions are being detected together with the desired analyte ions and hence whether or not the ion signal is reliable. Equally, if the ion beam is substantially free from the presence of interference ions then the ion signal from the two detectors will be substantially equal and it can be concluded to a high degree of confidence that the intended analyte ions are being detected without undesired interference ions affecting the measurement of the intensity of the analyte ions.

It will be seen from FIG. 10 that when the ion beam is switched to the central position each detector of the preferred split ion detector 11 is not detecting the maximum number of ions that it would detect if the ion beam were shifted by 12.5 ppm. The ion beam is not therefore positioned at the peak top for either of the two detectors of the preferred split ion detector 11 even though it is positioned at the peak top of the peak profile $P_{sum}$ for the sum of the peak profiles $P_1$,$P_2$ of the individual detectors. This means that a very small shift in the position of the ion beam will cause the signal on one of the detectors to increase whilst the signal on the other detector will simultaneously decrease. Hence, the preferred split ion detector 11 is very sensitive to small shifts in the position of the ion beam and very sensitive to the presence of interference ions.

The effect of a small shift in the position of the ion beam will be further illustrated with reference to FIG. 11. With the table shown in FIG. 11 it is assumed that the resolution of the preferred ion detector 11 is 10,000 (10% valley definition) and that only 20 ions are transmitted through the collector slit 3 and are subsequently detected by the preferred split ion detector 11. In this illustration the ion beam and the collector slit 3 both have a width of 50 ppm resulting in an observed peak profile width of 100 ppm.

Column 1 of FIG. 11 tabulates a series of shifts in the ion beam away from the centre of the collector slit in units of ppm. Column 2 tabulates the corresponding number of ions that would be detected on the first detector of the preferred split ion detector 11 for the corresponding shift in the ion beam detailed in column 1. Column 3 similarly tabulates the number of ions that would be detected on the second detector for the same corresponding shift in the ion beam.

Column 4 tabulates the total number of ions detected by the first and second detectors, i.e. the sum of columns 2 and 3. It can be seen that as the position of the ion beam is increasingly shifted away from the centre then the total number of ions detected is reduced. This is because the ion beam and the collector slit 3 are the same width and as the ion beam is moved off centre not all of the ions in the ion beam will be incident upon the collector slit 3 and hence not all of the ions will be onwardly transmitted.

Column 5 tabulates the average number of ions that would have been expected to have been detected on each of the first and second detectors had the ion beam been positioned on the centre given the total ion count reported in column 4. In other words, column 5 simply reports half the total number of ions reported in column 4 for each value of ion beam shift. Column 6 tabulates one standard deviation for the expected ion count for each of the first and second detectors which is reported in column 5.

Column 7 tabulates the difference between the actual ion count for the first detector reported in column 2, and the ion count that would have been expected as reported in column 5, expressed in terms of the number of standard deviations of the expected ion count tabulated in column 6. Column 8 similarly tabulates the difference, in terms of standard deviations, between the actual ion count for the second detector reported in column 3, and the expected count reported in column 5, again expressed in terms of the number of standard deviations of the expected ion count tabulated in column 6.

Column 9 tabulates the percentage probability P1 for the difference in ion count from the expected average being equal to or less than the actual difference in ion count reported for the first detector in column 7 assuming a natural or Gaussian distribution. Likewise, column 10 tabulates the same percentage probability P2 for the difference in ion count reported for the second detector in column 8. Hence columns 9 and 10 report the percentage probability of observing measurements within the relative standard deviations reported in columns 7 and 8 respectively, were an ion beam having the number of electrons reported in column 4 centred on the collector slit. Finally, column 11 tabulates the combined percentage probability P of both observing a measurement outside of the relative standard deviation reported in column 7 and a measurement outside of the relative standard deviation reported in column 8. In other words, column 11 reports the percentage probability of observing the two ion counts recorded on the first and second detectors for a peak having a total ion count equal to the sum of the two separate ion counts and positioned centrally.

It will be seen from FIG. 11 that the ion counts on the two detectors corresponding to an ion beam comprising only 20 ions and wherein the beam of ions is shifted by just 5 ppm is such that the probability that the observed ion counts could be observed if the ion beam were positioned centrally is only approximately 13%. Furthermore, the ion counts on the two detectors from an ion beam comprising only 20 ions wherein the ion beam is shifted by 10 ppm is such that the probability that the observed ion counts would be observed if the ion beam were positioned centrally is only 1%. Similarly, if the ion beam is shifted by 15 ppm then the probability that the observed ion counts would be observed if the ion beam were positioned centrally is only 0.1%.

In this example, it is apparent that the benefit of using a split ion detector according to the preferred embodiment is such that for the measurement of an ion beam comprising just 20 ions it could be ascertained with a 99% confidence that the observed mass peak is not an interfering peak due to the ion beam being displaced by only 10 ppm. Alternatively, it could be ascertained with a 99.9% confidence that the observed mass peak is not an interfering mass peak due to the ion beam being displaced by 15 ppm.

In contrast, using a conventional ion detector it would be necessary to operate with a mass peak width at 5% height of approximately 20 ppm to achieve the same specificity. This would correspond to an extremely high resolution of approximately 50,000 (10% valley definition) in contrast to 10,000 according to the preferred embodiment. Therefore, in this example, it is apparent that the split ion detector according to the preferred embodiment provides approximately a five-fold increase in specificity compared to a comparable conventional ion detector.

Alternatively, the preferred split ion detector may be considered as providing the same specificity but being between 5 and 25 times more sensitive as this is the likely loss in sensitivity resulting from increasing the resolution of the mass spectrometer five fold from 10,000 to 50,000 (10% valley definition).

FIG. 12 shows another example of the effect of small shifts in the position of an ion beam incident upon a preferred ion detector. The resolution of the preferred ion detector in this example has been reduced to 2000 (10% valley definition). As a consequence it has been assumed that the transmission has been increased by a factor of five so that the total number of ions detected by the preferred split ion detector has increased to 100. In this illustration the ion beam width and the collector slit 3 width are both 250 ppm resulting in a peak width of 500 ppm. It will be seen from FIG. 12 that the ion counts on the two detectors due to the ion beam being shifted by 20 ppm from the centre are such that the probability that the observed ion counts could be observed if the ion beam were positioned centrally on the collector slit is only 1%. This example illustrates the benefit of using a split ion detector according to the preferred embodiment since for the measurement of a peak corresponding to 100 ions at a resolution of 2000 (10% valley definition) it could be ascertained with a 99% confidence that the peak is not an interfering peak displaced by only 20 ppm. In contrast, using a conventional ion detector it would be necessary to operate with a peak width at 5% height of 40 ppm to achieve the same specificity. This corresponds to a high resolution of 25,000 (10% valley definition) compared to a resolution of just 2000 according to the preferred embodiment. It also follows that the preferred split ion detector will have both an increased sensitivity and an increased specificity compared to that achievable with a conventional ion detector operating at a resolution of 10,000 (10% valley definition).

It has been shown that the split ion detector according to the preferred embodiment can either improve the specificity of mass analysis without loss in sensitivity, or can provide an improved sensitivity without loss in specificity, or indeed can provide both improved sensitivity and specificity. Furthermore, randomly scattered ions that constitute background noise can at least be partially if not substantially eliminated.

Although the present invention has been described with reference to preferred embodiments, it will be understood by those skilled in the art that various changes in form and detail may be made without departing from the scope of the invention as set forth in the accompanying claims.

The invention claimed is:

1. A magnetic sector mass spectrometer comprising:

a magnetic sector mass analyser;

a collector slit arranged downstream of said magnetic sector mass analyser;

a device arranged downstream of said collector slit for dividing an ion beam transmitted through said collector slit into at least a first ion beam and a second ion beam;

a first detector for measuring the intensity of at least a portion of said first ion beam; and a second detector for measuring the intensity of at least a portion of said second ion beam.

2. A magnetic sector mass spectrometer as claimed in claim 1, wherein said ion beam has a first direction and a second orthogonal direction.

3. A magnetic sector mass spectrometer as claimed in claim 2, wherein ions in said ion beam are dispersed according to their mass to charge ratio in said first direction so that the mass to charge ratio of ions in said ion beam varies along said first direction.

4. A magnetic sector mass spectrometer as claimed in claim 2, wherein ions in said ion beam are substantially not dispersed according to their mass to charge ratio in said second direction so that the mass to charge ratio of ions in said ion beam is substantially constant along said second direction.

5. A magnetic sector mass spectrometer as claimed in claim 1, wherein, in use, said first and second detectors measure the intensities of at least a portion of said first and second ion beams at substantially the same time.

6. A magnetic sector mass spectrometer as claimed in claim 1, wherein said magnetic sector mass spectrometer comprises a single focusing magnetic sector mass spectrometer.

7. A magnetic sector mass spectrometer as claimed in claim 1, wherein said magnetic sector mass spectrometer comprises a double focusing magnetic sector mass spectrometer.

8. A magnetic sector mass spectrometer as claimed in claim 1, wherein said device comprises an electrode which causes ions to be reflected or deflected onto said first and second detectors.

9. A magnetic sector mass spectrometer as claimed in claim 8, wherein said electrode comprises a finely edged blade.

10. A magnetic sector mass spectrometer as claimed in claim 8, wherein said electrode comprises a wedge shaped electrode.

11. A magnetic sector mass spectrometer as claimed in claim 8, wherein said electrode comprises an edge and wherein, in use, analyte ions in said ion beam approaching said edge are arranged so that they are disposed substantially uniformly and/or symmetrically relative to said edge.

12. A magnetic sector mass spectrometer as claimed in claim 8, wherein said electrode comprises an edge and wherein, in use, interference ions in said ion beam approaching said edge are arranged so that they are disposed substantially non-uniformly and/or asymmetrically relative to said edge.

13. A magnetic sector mass spectrometer as claimed in claim 1, further comprising an Electron Impact ("EI") ion source.

14. A magnetic sector mass spectrometer as claimed in claim 1, further comprising a Chemical Ionisation ("CI") ion source.

15. A magnetic sector mass spectrometer as claimed in claim 1, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Matrix Assisted Laser Desorption Ionisation ("MALDI") ion source; (v) a Laser Desorption Ionisation ("LDI") ion source; (vi) an Inductively Coupled Plasma ("ICP") ion source; (vii) a Fast Atom Bombardment ("FAB") ion source; (viii) a Liquid Secondary Ions Mass Spectrometry ("LSIMS") ion source; (ix) a Field Ionisation ("FI") ion source; and (x) a Field Desorption ("FD") ion source.

16. A magnetic sector mass spectrometer as claimed in claim 1, further comprising a continuous ion source.

17. A magnetic sector mass spectrometer as claimed in claim 1, further comprising a pulsed ion source.

18. A magnetic sector mass spectrometer as claimed in claim 13, wherein, in use, a voltage difference is maintained between said device and said ion source selected from the group consisting of: (i) 0-100 V; (ii) 100-200 V; (iii) 200-300 V; (iv) 300-400 V; (v) 400-500 V; (vi) 500-600 V; (vii) 600-700 V; (viii) 700-800 V; (ix) 800-900 V; (x) 900-1000 V; and (xi) >1000 V.

19. A magnetic sector mass spectrometer as claimed in claim 1, further comprising a processor, said processor determining, in use, the intensity of at least a portion of said first ion beam relative to the intensity of at least a portion of said second ion beam.

20. A magnetic sector mass spectrometer as claimed in claim 1, wherein if the intensity of at least a portion of said first ion beam differs from the intensity of at least a portion of said second ion beam by ≧x %, then a determination is made that said ion beam includes a significant proportion of interference ions, wherein x is selected from the group consisting of: (i) 1; (ii) 2; (iii) 3; (iv) 4; (v) 5; (vi) 6; (vii) 7; (viii) 8; (ix) 9; (x) 10; (xi) 15; (xii) 20; (xiii) 25; (xiv) 30; (xv) 35; (xvi) 40; (xvii) 45; (xviii) 50; (xix) 55; (xx) 60; (xxi) 65; (xxii) 70; (xxiii) 75; (xxiv) 80; (xxv) 85; (xxvi) 90; (xxvii) 95; (xxviii) 100; and (xxix) >100.

21. A magnetic sector mass spectrometer as claimed in claim 1, wherein if the intensity of at least a portion of said second ion beam differs from the intensity of at least a portion of said first ion beam by ≧x %, then a determination is made that said ion beam includes a significant proportion of interference ions, wherein x is selected from the group consisting of: (i) 1; (ii) 2; (iii) 3; (iv) 4; (v) 5; (vi) 6; (vii) 7; (viii) 8; (ix) 9; (x) 10; (xi) 15; (xii) 20; (xiii) 25; (xiv) 30; (xv) 35; (xvi) 40; (xvii) 45; (xviii) 50; (xix) 55; (xx) 60; (xxi) 65; (xxii) 70; (xxiii) 75; (xxiv) 80; (xxv) 85; (xxvi) 90; (xxvii) 95; (xxviii) 100; and (xxix) >100.

22. A magnetic sector mass spectrometer as claimed in claim 1, wherein if within a time t the number of ions detected by said first detector differs from the number of ions detected by said second detector by ≧y standard deviations of the total number of ions detected by said first and second detectors during said time t, then a determination is made that said ion beam includes a significant proportion of interference ions, wherein y is selected from the group consisting of: (i) 0.25; (ii) 0.5; (iii) 0.75; (iv) 1.0; (v) 1.25; (vi) 1.5; (vii) 1.75; (viii) 2.0; (ix) 2.25; (x) 2.5; (xi) 2.75; (xii) 3.0; (xiii) 3.25; (xiv) 3.5; (xv) 3.75; (xvi) 4.0; and (xvii) >4.0.

23. A magnetic sector mass spectrometer as claimed in claim 1, wherein signals from said first and second detectors are summed to produce a combined signal and wherein said combined signal is multiplied by a weighting factor.

24. A magnetic sector mass spectrometer as claimed in claim 23, wherein said weighting factor:

(i) does not substantially attenuate said combined signal when the signal from said first detector substantially equals the signal from said second detector; and/or (ii) substantially attenuates said combined signal when the signal from said first detector substantially differs from the signal from said second detector.

25. A magnetic sector mass spectrometer as claimed in claim 23, wherein said weighting factor is of the form $\exp(-ky^n)$ wherein k and n are constants and wherein within a time t the number of ions detected by said first detector differs from the number of ions detected by said second detector by y standard deviations of the total number of ions detected by said first and second detectors during said time t.

26. A magnetic sector mass spectrometer as claimed in claim 25, wherein k is selected from the group consisting of: (i) 0.5-2.0; (ii) 0.6-1.8; (iii) 0.7-1.6; (iv) 0.8-1.4; (v) 0.9-1.2; (vi) 0.95-1.1; and (vii) 1.

27. A magnetic sector mass spectrometer as claimed in claim 25, wherein n is selected from the group consisting of: (i) 1.0-3.0; (ii) 1.2-2.8; (iii) 1.4-2.6; (iv) 1.6-2.4; (v) 1.8-2.2; (vi) 1.9-2.1; and (vii) 2.

28. A magnetic sector mass spectrometer as claimed in claim 1, wherein if a determination is made that said ion beam includes a significant proportion of interference ions then signals from said first and/or said second detectors are discarded or are otherwise deemed to be relatively inaccurate.

29. A magnetic sector mass spectrometer as claimed in claim 1, wherein if a determination is made that said ion beam does not include a significant proportion of interference ions then signals from said first and second detectors are summed or are otherwise deemed to be relatively accurate.

30. A magnetic sector mass spectrometer as claimed in claim 1, further comprising a lens arranged downstream of said collector slit.

31. A magnetic sector mass spectrometer as claimed in claim 30, wherein said lens refocuses the image of said collector slit onto said device.

32. A magnetic sector mass spectrometer as claimed in claim 30, wherein said lens substantially collimates said ion beam.

33. A magnetic sector mass spectrometer as claimed in claim 1, further comprising a screening tube for guiding ions onto said device.

34. A magnetic sector mass spectrometer as claimed in claim 33, wherein said screening tube is arranged between said collector slit and said device.

35. A magnetic sector mass spectrometer as claimed in claim 33, wherein said screening tube shields said ion beam from voltages applied to said first and/or said second detector.

36. A magnetic sector mass spectrometer as claimed in claim 1, wherein said first detector comprises one, two, three, four, five, six, seven, eight, nine, ten or more than ten microchannel plate detectors.

37. A magnetic sector mass spectrometer as claimed in claim 1, wherein said first detector comprises one, two, three, four, five, six, seven, eight, nine, ten or more than ten conversion dynode(s) for generating electrons in response to ions impinging upon said conversion dynode(s).

38. A magnetic sector mass spectrometer as claimed in claim 37, further comprising one or more electron multipliers and/or one or more microchannel plate detectors for detecting electrons generated by said conversion dynode(s).

39. A magnetic sector mass spectrometer as claimed in claim 37, further comprising one or more scintillators and/or one or more phosphers upon which electrons generated by said conversion dynode(s) are received in use and wherein said one or more scintilators and/or said one or more phosphers generate photons in response to receiving electrons.

40. A magnetic sector mass spectrometer as claimed in claim 39, further comprising one or more photo-multiplier tubes and/or one or more photo-sensitive solid state detectors for detecting said photons.

41. A magnetic sector mass spectrometer as claimed in claim 1, wherein said second detector comprises one, two, three, four, five, six, seven, eight, nine, ten or more than ten microchannel plate detectors.

42. A magnetic sector mass spectrometer as claimed in claim 1, wherein said second detector comprises one, two, three, four, five, six, seven, eight, nine, ten or more than ten conversion dynode(s) for generating electrons in response to ions impinging upon said conversion dynode(s).

43. A magnetic sector mass spectrometer as claimed in claim 42, further comprising one or more electron multipliers and/or one or more microchannel plate detectors for detecting electrons generated by said conversion dynode(s).

44. A magnetic sector mass spectrometer as claimed in claim 42, further comprising one or more scintillators and/or one or more phosphers upon which electrons generated by said conversion dynode(s) are received in use and wherein said one or more scintilators and/or said one or more phosphers generate photons in response to receiving electrons.

45. A magnetic sector mass spectrometer as claimed in claim 44, further comprising one or more photo-multiplier tubes and/or one or more photo-sensitive solid state detectors for detecting said photons.

46. A magnetic sector mass spectrometer as claimed in claim 1, further comprising an additional detector arranged upstream of said first and second detectors.

47. A magnetic sector mass spectrometer as claimed in claim 46, wherein said additional detector comprises a conversion dynode.

48. A magnetic sector mass spectrometer as claimed in claim 47, wherein in a mode of operation at least a portion of an ion beam is deflected onto said conversion dynode and wherein said conversion dynode generates electrons in response thereto.

49. A magnetic sector mass spectrometer as claimed in claim 48, further comprising one or more electron multipliers and/or one or more microchannel plate detectors for receiving electrons generated by said conversion dynode.

50. A magnetic sector mass spectrometer as claimed in claim 48, further comprising one or more scintillators and/or one or more phosphers upon which electrons generated by said conversion dynode are received in use and wherein said one or more scintillators and/or said one or more phosphers generate photons in response to receiving electrons.

51. A magnetic sector mass spectrometer as claimed in claim 50, further comprising one or more photo-multiplier tubes and/or one or more photo-sensitive solid state detectors for detecting said photons.

52. A magnetic sector mass spectrometer as claimed in claim 1, wherein the gain of said first and/or said second detector can be independently adjusted.

53. A magnetic sector mass spectrometer as claimed in claim 52, wherein said first and second detectors are powered by independently adjustable power supplies.

54. A magnetic sector mass spectrometer as claimed in claim 1, wherein said first and second detectors further comprise one or more Analogue to Digital Converters and/or one or more ion counting detectors.

55. A magnetic sector mass spectrometer as claimed in claim 1, further comprising adjustment means for centering said ion beam on to said device.

56. A magnetic sector mass spectrometer as claimed in claim 55, wherein said adjustment means comprises at least one deflecting electrode downstream of said collector slit, said deflecting electrode being arranged to move said ion beam relative to said device.

57. A method of mass spectrometry comprising:

transmitting an ion beam through a magnetic sector mass analyser and a collector slit arranged downstream of said magnetic sector mass analyser;

dividing said ion beam downstream of said collector slit into at least a first ion beam and a second ion beam;

measuring the intensity of at least a portion of said first ion beam with a first detector; and measuring the intensity of at least a portion of said second ion beam with a second detector.

58. A method of mass spectrometry as claimed in claim 57, wherein said ion beam has a first direction and a second orthogonal direction.

59. A method of mass spectrometry as claimed in claim 58, wherein ions in said ion beam are dispersed according to their mass to charge ratio in said first direction so that the mass to charge ratio of ions in said ion beam varies along said first direction.

60. A method of mass spectrometry as claimed in claim 58, wherein ions in said ion beam are substantially not dispersed according to their mass to charge ratio in said second direction so that the mass to charge ratio of ions in said ion beam is substantially constant along said second direction.

61. A method of mass spectrometry as claimed in claim 57, wherein, in use, said first and second detectors measure the intensities of at least a portion of said first and second ion beams at substantially the same time.

62. A method of mass spectrometry as claimed in claim 57, further comprising determining the intensity of at least a portion of said first ion beam relative to the intensity of at least a portion of said second ion beam.

63. A method of mass spectrometry as claimed in claim 57, wherein if the intensity of at least a portion of said first ion beam differs from the intensity of at least a portion of said second ion beam by $\geqq x$ %, then a determination is made that said ion beam includes a significant proportion of interference ions, wherein x is selected from the group consisting of: (i) 1; (ii) 2; (iii) 3; (iv) 4; (v) 5; (vi) 6; (vii) 7; (viii) 8; (ix) 9; (x) 10; (xi) 15; (xii) 20; (xiii) 25; (xiv) 30; (xv) 35; (xvi) 40;

(xvii) 45; (xviii) 50; (xix) 55; (xx) 60; (xxi) 65; (xxii) 70; (xxiii) 75; (xxiv) 80; (xxv) 85; (xxvi) 90; (xxvii) 95; (xxviii) 100; and (xxix) >100.

64. A method of mass spectrometry as claimed in claim 57, wherein if the intensity of at least a portion of said second ion beam differs from the intensity of at least a portion of said first ion beam by ≧x %, then a determination is made that said ion beam includes a significant proportion of interference ions, wherein x is selected from the group consisting of: (i) 1; (ii) 2; (iii) 3; (iv) 4; (v) 5; (vi) 6; (vii) 7; (viii) 8; (ix) 9; (x) 10; (xi) 15; (xii) 20; (xiii) 25; (xiv) 30; (xv) 35; (xvi) 40; (xvii) 45; (xviii) 50; (xix) 55; (xx) 60; (xxi) 65; (xxii) 70; (xxiii) 75; (xxiv) 80; (xxv) 85; (xxvi) 90; (xxvii) 95; (xxviii) 100; and (xxix) >100.

65. A method of mass spectrometry as claimed in claim 57, wherein if within a time t the number of ions detected by said first detector differs from the number of ions detected by said second detector by ≧y standard deviations of the total number of ions detected by said first and second detectors during said time t, then a determination is made that said ion beam includes a significant proportion of interference ions, wherein y is selected from the group consisting of: (i) 0.25; (ii) 0.5; (iii) 0.75; (iv) 1.0; (v) 1.25; (vi) 1.5; (vii) 1.75; (viii) 2.0; (ix) 2.25; (x) 2.5; (xi) 2.75; (xii) 3.0; (xiii) 3.25; (xiv) 3.5; (xv) 3.75; (xvi) 4.0; and (xvii) >4.0.

66. A method of mass spectrometry as claimed in claim 57, further comprising:

summing signals from said first and second detectors to produce a combined signal; and multiplying said combined signal by a weighting factor.

67. A method of mass spectrometry as claimed in claim 66, wherein said weighting factor:

(i) does not substantially attenuate said combined signal when the signal from said first detector substantially equals the signal from said second detector; and/or (ii) substantially attenuates said combined signal when the signal from said first detector substantially differs from the signal from said second detector.

68. A method of mass spectrometry as claimed in claim 66, wherein said weighting factor is of the form $\exp(-ky^n)$ wherein k and n are constants and wherein within a time t the number of ions detected by said first detector differs from the number of ions detected by said second detector by y standard deviations of the total number of ions detected by said first and second detectors during said time t.

69. A method of mass spectrometry as claimed in claim 68, wherein k is selected from the group consisting of: (i) 0.5-2.0; (ii) 0.6-1.8; (iii) 0.7-1.6; (iv) 0.8-1.4; (v) 0.9-1.2; (vi) 0.95-1.1; and (vii) 1.

70. A method of mass spectrometry as claimed in claim 68, wherein n is selected from the group consisting of: (i) 1.0-3.0; (ii) 1.2-2.8; (iii) 1.4-2.6; (iv) 1.6-2.4; (v) 1.8-2.2; (vi) 1.9-2.1; and (vii) 2.

71. A method of mass spectrometry as claimed in claim 57, wherein if a determination is made that said ion beam includes a significant proportion of interference ions then signals from said first and/or said second detectors are discarded or are otherwise deemed to be relatively inaccurate.

72. A method of mass spectrometry as claimed in claim 57, wherein if a determination is made that said ion beam does not include a significant proportion of interference ions then signals from said first and second detectors are summed or are otherwise deemed to be relatively accurate.

* * * * *